US005126236A

United States Patent [19]

Mihayashi et al.

[11] Patent Number: 5,126,236

[45] Date of Patent: Jun. 30, 1992

[54] COLOR PHOTOGRAPHIC MATERIALS WITH DIR COMPOUND COMBINATIONS

[75] Inventors: Keiji Mihayashi; Seiji Ichijima, both of Kanagawa, Japan

[73] Assignee: Fuji Photo Film Co., Ltd., Kanagawa, Japan

[21] Appl. No.: 681,639

[22] Filed: Apr. 4, 1991

Related U.S. Application Data

[63] Continuation of Ser. No. 330,531, Mar. 30, 1989, abandoned, which is a continuation of Ser. No. 861,766, Mar. 5, 1986, abandoned.

[30] Foreign Application Priority Data

May 9, 1985 [JP] Japan ..... 60-98718

[51] Int. Cl.[5] ..... G03C 7/26; G03C 7/32

[52] U.S. Cl. ..... 430/505; 430/544; 430/957

[58] Field of Search ..... 430/544, 505, 957, 566

[56] References Cited

U.S. PATENT DOCUMENTS

| | | | |
|---|---|---|---|
| 3,106,621 | 1/1982 | Odenwalder | 430/443 |
| 4,015,988 | 4/1977 | Shiba et al. | 430/508 |
| 4,108,663 | 8/1978 | Tanaka et al. | 430/505 |
| 4,248,962 | 2/1981 | Lau | 430/382 |
| 4,355,100 | 10/1982 | Sagita et al. | 430/544 |
| 4,390,618 | 6/1983 | Kobayashi | 430/543 |
| 4,409,323 | 10/1983 | Sato et al. | 430/544 |
| 4,438,193 | 3/1984 | Uemura et al. | 430/544 |
| 4,477,560 | 10/1984 | Kaitoshi et al. | 430/506 |
| 4,500,633 | 2/1985 | Menjo et al. | 430/544 |
| 4,511,649 | 4/1985 | Ogawa et al. | 430/553 |
| 4,524,130 | 6/1985 | Iwasa et al. | 430/505 |
| 4,528,263 | 7/1985 | Sugita | 430/544 |
| 4,618,571 | 10/1986 | Ichijima et al. | 430/505 |
| 4,652,516 | 3/1987 | Ichijima et al. | 430/544 |

FOREIGN PATENT DOCUMENTS

| | | |
|---|---|---|
| 086654 | 8/1983 | European Pat. Off. . |
| 0157146 | 10/1985 | European Pat. Off. . |
| 1536341 | 12/1978 | United Kingdom . |

OTHER PUBLICATIONS

Patents Abstracts of Japan, vol. 6, No. 241 (p-158) [1119], Nov. 30, 1982; JP-A-57 138636, published Aug. 27, 1982.

*Primary Examiner*—Richard L. Schilling
*Attorney, Agent, or Firm*—Sughrue, Mion, Zinn, Macpeak & Seas

[57] ABSTRACT

A silver halide color photographic material is described, comprising a support having disposed thereon at least one layer each of blue sensitive silver halide emulsion, green sensitive silver halide emulsion and red sensitive silver halide emulsion layer units, wherein at least one of (a) a compound which upon reaction with an oxidized developing agent forms a compound which on oxidation forms a development inhibitor or a precursor thereof and (b) a compound which upon reaction with an oxidized developing agent forms a precursor of a compound which on oxidation forms a development inhibitor or a precursor thereof, and (c) a compound which on reaction with an oxidized developing agent releases a development inhibitor or a precursor thereof are incorporated in the same color sensitive layer or in the same non-sensitive layer.

33 Claims, No Drawings

COLOR PHOTOGRAPHIC MATERIALS WITH DIR COMPOUND COMBINATIONS

This is a continuation of application Ser. No. 07/330,531 filed Mar. 30, 1989, now abandoned, which is a continuation of application Ser. No. 06/861,766, filed Mar. 5, 1986, now abandoned.

FIELD OF THE INVENTION

The present invention relates to a silver halide color photographic material which is excellent in sharpness, graininess and color reproduction and is of low dependence on processing.

BACKGROUND OF THE INVENTION

Recently, in the field of silver halide photographic materials and, particularly, with picture taking photosensitive materials, there has been a demand for photosensitive materials of extremely high sensitivity, e.g., as represented by the ISO 1600 films, which also exhibit high image quality and high sharpness and which are suitable for compact format cameras such as 110-size cameras and disk cameras.

A known means of improving the sharpness and granularity of developed images comprises incorporating in a silver halide color photographic material a compound (hereinafter referred to as a DIR compound) which releases a development inhibitor in accordance with image density at development.

Such DIR compounds are generally of the type which react with the oxidation product of an aromatic primary amine developer to release a development inhibitor. As a representative class of such compounds, there are known DIR couplers which, in their coupling position, have a group adapted to form a compound having development inhibiting activity upon cleavage from the coupling position (for example, the compounds as described in U.S. Pat. Nos. 3,227,554, 3,701.783, 4,095,984, 4,149,886, 3,933,500, 4,146,396 and 4,477,563). When such DIR couplers undergo a coupling reaction with an oxidized aromatic primary amine developing agent, the coupler nucleus forms a dye while a development inhibitor is released.

As a class of compounds which undergo a coupling reaction with an oxidized aromatic primary amine developing agent to yield a colorless coupling reaction product and, at the same time, release a development inhibitor, there are known various compounds including the compounds described in U.S. Pat. Nos. 3,632,345, 3,928,041, 3,958,993, 3,961,959 and 4,052,213 and Japanese Patent Application (OPI) Nos. 53-110529 and 54-13333 (the term "OPI" as used herein refers to a "published unexamined Japanese patent application").

DIR hydroquinones, which release development inhibitors upon a cross-oxidation reaction with an oxidized developing agent, are also known. Examples of DIR hydroquinones include the compounds described in U.S. Pat. Nos. 3,379,529 and 3,930,863.

However, these compounds have the disadvantage that they suffer from a decrease in their desired function upon decomposition or undergo desensitization during storage of films containing the same after coating, and their beneficial effects on image sharpness are not very satisfactory.

A category of compounds which, on coupling with an oxidized aromatic primary amine developing agent, release a development inhibitor with a timed release effect can be exemplified by the compounds described in U.S. Pat. No. 4,248,962 and Japanese Patent Application (OPI) No. 57-56837.

It is true that, with this last type of compounds, an inhibitory effect can be realized a certain distance from a developed silver halide grain so that at least theoretically a "neighboring group" effect may enhance edge sharpness. Actually, however, as the timing of these compounds is not well controlled, they do not contribute much to the sharpness of developed images. Furthermore, as hydrolysis or cleavage inevitably occurs under high humidity storage conditions, problems such as desensitization and a decrease in their desired function are frequently encountered.

To overcome the above problems, Japanese Patent Application No. 59-33059 (corresponding to U.S. patent application Ser. No. 705,473 filed on Feb. 25, 1985 now U.S. Pat. No. 4,618,571) proposes a class of compounds where the compounds released therefrom upon a coupling reaction with one molecule of oxidized developing agent further undergo a redox reaction with another molecule of oxidized developing agent to release a photographically useful group such as a development inhibitor. This class of compounds have the general formula:

A-RED-PUG where A means a coupler residue which undergoes a coupling reaction with an oxidized developing agent to release RED-PUG; RED means a group which, after cleavage from A, undergoes a redox reaction an oxidized developing agent and releases PUG; and PUG means a group which, after cleavage form RED, exhibits a substantial photographic action.

Photosensitive materials containing compounds adapted to ultimately release a development inhibitor, among the above mentioned compounds, are good in shelf life and, particularly, provide markedly improved imaged sharpness. However, when these photosensitive materials are developed, the increased fatigue of the processing solution results in changes in photographic characteristics, e.g., the development inhibiting effect is excessive under certain conditions while the reverse is true under other conditions, so that it is difficult to obtain stable effects at all times. It has also become clear that they have the serious disadvantage in that, depending on developing conditions, an uneven finish can result even within the same image frame.

The concept of using two or more different DIR compounds in silver halide photosensitive materials is disclosed, for example, in Japanese Patent Application (OPI) No. 50-119631 (corresponding to U.S. Pat. No. 4,015,988), which teaches the combined use of a DIR hydroquinone with a DIR coupler. This combination, however, has not proven sufficiently effective because of a large desensitization of the DIR hydroquinone compound.

Japanese Patent Application (OPI) No. 51-113625 teaches the simultaneous use of mercapto type development inhibitor releasing compounds having dissimilar coupling activities, but the underlying principle of this art is no more than such that the rate of release of the development inhibitor is controlled through differences in coupling activity so as to obtain satisfactory tone reproduction; the effect achieved thereby is quite different from the effect achieved by the combination of compounds according to the present invention which will hereinafter be described in detail.

Japanese Patent Application (OPI) No. 56-137353 teaches the combined use of a compound having a timing group and a compound which does not have a timing group with regard to the release of a development inhibitor, and Japanese Patent Application (OPI) No. 57-173836 teaches the combined use of a mercapto type development inhibitor releasing compound having a cleavage group and a mercapto type development inhibitor releasing compound having no such group. However, these techniques are based on the concept that two compounds having two different functions, namely a compound for providing "interimage" effects and a compound satisfying granularity requirements, are used in combination to achieve the respective effects as a mere sum of the two functions.

Japanese Patent Application (OPI) No. 56-116029 (corresponding to U.S. Pat. No. Re 31,893) teaches the combined use of a development inhibitor releasing compound having an amino group and a development inhibitor releasing compound having no amino group but it appears that this technique is also based on the concept of satisfying image quality requirements and formaldehyde resistance requirements through a mere summation of the effects of the individual compounds.

In contrast, as will be explained fully hereinafter, the effects according to the present invention are implemented by a mechanism quite different from prior art technology involving combinations of compounds.

Japanese Patent Application (OPI) No. 57-138636 describes a compound which corresponds to the compounds of the present invention minus the development inhibitor moiety, that is, a compound which releases a scavenger for oxidized developing agent. However, the compounds according to the present invention have the capability to undergo a coupling reaction with oxidized developing agent and release a development inhibitor upon reaction with another molecule of oxidized developing agent, and its effect is primarily that of development inhibition, as disclosed in Japanese Patent Application No. 59-33059, with little scavenging or cleaning out effects for oxidized developing agent. Thus, the effects are quite different from those of the above mentioned patent application.

Further, Japanese Patent Application (OPI) No. 57-155537 teaches the combined use of the above compound and a conventional DIR compound, but the purpose and rationale of such art is to utilize an oxidized developing agent scavenger releasing compound to compensate for disadvantages such as the adverse influence of the conventional development inhibitor releasing DIR compound on tone reproduction and contamination of processing solutions and, therefore, the technique of this art is quite different from the present invention in which a development inhibitor releasing compound is present in addition to a conventional DIR compound.

SUMMARY OF THE INVENTION

It is an object of the present invention to provide a silver halide color photographic material of excellent sharpness, graininess and color reproduction with decreased processing dependence. Other objects of the present invention will become apparent as the following detailed description of the invention proceeds.

The above mentioned objects are accomplished by the present invention which comprises a silver halide color photographic material including a support having disposed thereon at least one each of a blue-sensitive silver halide emulsion layer unit, a green-sensitive silver halide emulsion layer unit and a red-sensitive silver halide emulsion layer unit and, further, containing at least one (a) compound which reacts with an oxidized developing agent to yield a compound which yields a development inhibitor or a precursor thereof on oxidation (hereafter referred to as compound (a)) and/or (b) at least one compound which reacts with an oxidized developing agent to yield a precursor of a compound which forms a development inhibitor or a precursor thereof on oxidation (hereafter referred to as compound (b)), and (c) at least one compound which reacts with an oxidized developing agent to release a development inhibitor or a precursor thereof (hereafter referred to as a compound (c)) in the same color sensitive layer or in the same non-photosensitive layer.

Thus, in accordance with the present invention it is mandatory to use at least one compound (a) and/or at least one compound (b) in combination with at least one compound (c).

DETAILED DESCRIPTION OF THE INVENTION

Preferred species of compound (a) and compound (b) in the present invention are represented by the following general formula (I).

$$A\text{-}B\text{-}D \qquad (I)$$

In formula (I), A is a coupler residue which reacts with an oxidized color developing agent to cleave from B; B is either a group which is oxidized after cleavage of A from B and thereby cleaved from D or a precursor thereof; and D is a development inhibitor or a precursor thereof.

Referring to general formula (I), B is preferably a group of general formula (B-1). In formula (B-1), the mark * indicates the position of attachment to A and the mark ** indicates the position of attachment to D.

$$*\text{-}(B_1)_v\text{-}\underset{\underset{(B_2)_w}{|}}{RED}\text{-}** \qquad (B\text{-}1)$$

In formula (B-1), $B_1$ is a linking group adapted to cleave from RED only after cleavage of the bond between $B_1$ and A; $B_2$ is a group adapted to react with an alkali, hydroxylamine, sulfite or like ion present in the development environment to undergo cleavage from RED; RED is a group that is rendered oxidizable only after cleavage of its bonds with $B_1$ and $B_2$ and, upon oxidation, cleaves from D (the same meaning as defined in general formula (I)); and v and w each represents 0 or 1.

In general formula (B-1), the group RED is preferably a group of general formula (R-1). In formula (R-1), the mark * indicates the position of attachment to $A\text{-}(B_1)_v$ and the mark ** indicates the position of attachment to $B_2$ (when w=1) or a hydrogen atom (when w=0).

$$*\text{-}P\text{-}(X{=}Y)_n\text{-}Q\text{-}** \qquad (R\text{-}1)$$

In general formula (R-1), P and Q each is an oxygen atom or a substituted or unsubstituted imino group; at least one of the n occurrences of X and of the n occurrences of Y is a methine group having D (which has the same meaning as defined for general formula (I)) as a substituent and the remaining occurrences of X and Y each is/are a substituted or unsubstituted methine group or a nitrogen atom; n is an integer of 1 to 3 and when n is not less than 2, n occurrences of X and n occurrences of Y can represent either the same or different species. Included is the case in which any two substituents on P, X, Y and Q are divalent groups forming a cyclic structure therebetween. For example, when $-(X=Y)_n-$ forms a benzene ring (n=1 and 2), the formula (R-1) has the following cyclic structure:

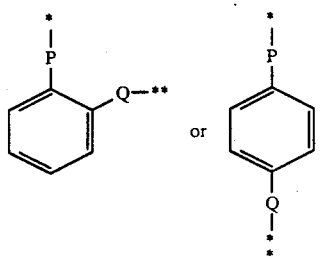

Referring further to general formula (B-1), $B_1$ is preferably one of the following groups.

(1) Groups which utilize the hemiacetal cleavage reaction. For example, such groups are described in U.S. Pat. No. 4,146,396 and Japanese Patent Application Nos. 59-106223, 59-106224 and 59-75475, and may be represented by the general formula given below. In the formula, the mark * indicates the position of attachment to A and the mark ** indicates the position of attachment to RED.

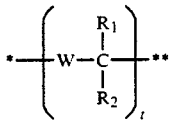

In the above formula, W is an oxygen atom or the group

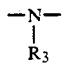

(where $R_3$ is an organic substituent group such as an acyl group (e.g., an acetyl group, a benzoyl group), a sulfonyl group (e.g., a methanesulfonyl group, a benzenesulfonyl group), an aliphatic group (e.g., a methyl group, an ethyl group) or a carbamoyl group (e.g., an ethylcarbamoyl group, a phenylcarbamoyl group)); $R_1$ and $R_2$ each is a hydrogen atom or a substituent group, preferably a substituent group such as an acyl group (e.g., a benzoyl group, an acetyl group), a carbamoyl group (e.g., an N-ethylcarbamoyl group, an N-phenylcarbamoyl group) or an aliphatic group (e.g., a methyl group, a butyl group); t is 1 or 2 and when t is 2, two occurrences of $R_1$ and $R_2$ may represent the same or different species. Included is the case in which any two of $R_1$, $R_2$ and $R_3$ are combined to form a cyclic structure. The typical example of such case having a cyclic structure is represented by the following formula:

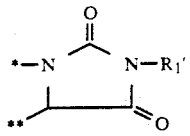

wherein the preferred $R_1'$ represents an aliphatic group having 1 to 5 carbon atoms (e.g., a methyl group, an ethyl group, a butyl group) or a hydrogen atom.

(2) Groups such that cleavage is induced by intramolecular nucleophilic displacement. Examples are the timing groups as described in U.S. Pat. No. 4,248,962.

(3) Groups such that cleavage is induced by electron transfer along a conjugated system. Examples include the groups described in U.S. Pat. No. 4,409,323 and the groups of the following general formula (the groups described in British Patent 2,096,783A).

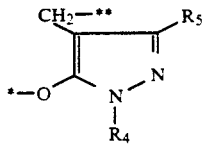

In the above formula, the mark * indicates the position of attachment to A; the mark ** indicates the position of attachment to RED; and $R_4$ and $R_5$ each is a hydrogen atom or a substituent group. The preferred substituent group of $R_4$ is an aliphatic group (e.g., a methyl group, a benzyl group), or an aromatic group (e.g., a phenyl group, a 2,4,6-trichlorophenyl group), and the preferred substituent group of $R_5$ is an aliphatic group (e.g., a methyl group, an ethyl group), an aromatic group (e.g., a phenyl group, a 4-methoxyphenyl group), or an alkoxycarbonyl group (e.g., a methoxycarbonyl group, an ethoxycarbonyl group).

Referring to general formula (B-1), $B_2$ is a group adapted to react with an alkali or a nucleophilic reagent available in the developer solution, such as hydroxylamine, sulfite ion, etc., and thereupon be cleaved from RED. Preferred species of $B_2$ are hydrolyzable groups such as acyl, alkoxycarbonyl, aryloxycarbonyl, carbamoyl, imidoyl, oxazolyl, sulfonyl, etc., precursor groups of the type utilizing a reverse Michael reaction as described in U.S. Pat. No. 4,009,029, precursor groups of the type where the anion generated upon ring opening reaction is utilized as an intramolecular nucleophilic group as described in U.S. Pat. No. 4,310,612, precursor groups such that an anion undergoes electron transfer along a conjugated system to thereby cause cleavage as described in U.S. Pat. Nos. 3,674,478, 3,932,480 or 3,993,661, precursor groups such that the electron transfer of an anion generated following ring fission causes cleavage as taught by U.S. Pat. No. 4,335,200, and precursor groups of the type wherein an imidomethyl group is utilized as described in U.S. Pat. Nos. 4,363,865 and 4,410,618.

Referring to general formula (B-1), preferred is the case in which v is 0 and w is 0.

In general formula (I), D is preferably a group having the following general formula (D-1). The mark * indicates the position of attachment to B.

$$*-(B)_q-DI \qquad \text{(D-1)}$$

In formula (D-1), $B_1$ has the same meaning as defined for general formula (B-1); q is 0 or 1; and DI is a development inhibitor bonding with "*-$(B_1)_q$-" through a sulfur atom, an oxygen atom or a nitrogen atom. Preferred examples of DI are tetrazolylthio, 1- or 2-benzotriazolyl, 1-benzoindazolyl, benzimidazolylthio, benzoxazolylthio, imidazolylthio, oxazolylthio, triazolylthio, oxadiazolylthio, thiadiazolylthio, and N-aryl-1,2,3,4-thiatriazol-5-amino groups (as aryl, a phenyl is preferred). The N-aryl-1,2,3,4-thiatriazol-5-amino group, as it is (after cleavage), does not have development inhibiting activity but undergoes rearrangement to give 5-mercapto-1-phenyltetrazole and thereby display an inhibitory effect. (This reaction is described in German Patent Specification Offenlegungschrift No. 3,307,506A).

The development inhibitors mentioned above may have substituents in their substitutable positions. Preferred examples of such substituents are aliphatic groups (e.g., methyl, ethyl), aromatic groups (e.g., phenyl, 4-chlorophenyl, etc.), halogen atoms (e.g., fluorine, chlorine, etc.), alkoxy groups (e.g., methoxy, benzyloxy), alkylthio groups (e.g., ethylthio, butylthio), aryloxy groups (e.g., phenoxy), arylthio groups (e.g., phenylthio), carbamoyl groups (e.g., N-ethylcarbamoyl), alkoxycarbonyl groups (e.g., methoxycarbonyl), aryloxycarbonyl groups (e.g., phenoxycarbonyl), sulfonyl groups (e.g., benzenesulfonyl, methanesulfonyl), sulfamoyl groups (e.g., N-ethylsulfamoyl), acylamino groups (e.g., acetamido, benzamido), sulfonamido groups (e.g., methanesulfonamido, benzenesulfonamido), acyl groups (e.g., acetyl, benzoyl), a nitroso group, acyloxy groups (e.g., acetoxy), ureido groups (e.g., 3-phenylureido, 3-ethylureido), imido groups (e.g., succinimido), a nitro group, a cyano group, heterocyclic groups (4- to 6-membered heterocyclic groups in which the hetero atom or atoms are selected from among nitrogen, oxygen and sulfur atoms, e.g., 2-furyl, 2-pyridyl, 1-imidazolyl, 1-morpholino), a hydroxy group, a carboxyl group, alkoxycarbonylamino groups (e.g., methoxycarbonylamino, phenoxycarbonylamino), a sulfo group, an amino group, anilino groups (e.g., 4-methoxyanilino), aliphatic amino groups (e.g., diethylamino), sulfinyl groups (e.g., ethylsulfinyl), sulfamoylamino groups (e.g., ethylsulfamoylamino), thioacyl groups (e.g., phenylthiocarbonyl), thioureido groups (e.g., 3-phenylthioureido) and heterocyclic amino groups (e.g., imidazolylamino). When any of the above mentioned substituents contains an aliphatic group, such aliphatic moiety contains 1 to 22 carbon atoms, preferably 1 to 10 carbon atoms, and may be acyclic or cyclic, straight chain or branched chain, saturated or unsaturated, and can be substituted or unsubstituted. When any of the above mentioned substituents has an aromatic group, such aromatic group contains 6 to 10 carbon atoms and is preferably a substituted or unsubstituted phenyl group.

Referring to general formula (D-1), preferred is the case in which q is 0.

In general formula (I), especially preferred couplers have the following general formula (II) or (III).

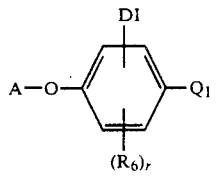

(II)

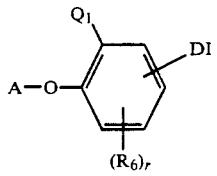

(III)

In formulae (II) and (III), A and DI have the same meanings as defined hereinbefore; $Q_1$ is a hydroxy or sulfonamido group, preferably a hydroxy group; $R_6$ is a hydrogen atom or a substituent group, which is preferably selected from among the substituents mentioned for DI in general formula (D-1), more preferably an alkoxy group (e.g., a methoxy group, an ethoxy group), a hydroxy group, a sulfonamido group (e.g., a methanesulfonamido group, a benzenesulfonamido group), an acylamino group (e.g., an acetamido group, a benzamido group), an aliphatic group (e.g., a methyl group, an ethyl group) or an alkylthio group (e.g., an ethylthio group, a butylthio group); and r is an integer of 1 to 3. When r is not less than 2, two or more occurrences of $R_6$ can represent the same or different species. When two occurrences of $R_6$ represent divalent substituents on adjacent carbon atoms, they may be cyclized therebetween to form a fused ring structure (a benzene condensed ring) such as benzonorbornene, chroman, indole, benzothiophene, quinoline, benzofuran, 2,3-dihydrobenzofuran, indane or indene.

When $Q_1$ is a sulfonamido group, the preferred sulfonamido group is selected from among aliphatic sulfonamido, aromatic sulfonamido and heterocyclic sulfonamido groups (e.g., a 2-pyridylsulfonamido group). The aliphatic sulfonamido group is a straight chain or branched chain, acyclic or cyclic, saturated or unsaturated, and substituted or unsubstituted aliphatic sulfonamido group having 1 to 20 carbon atoms, preferably 1 to 10 carbon atoms. The aryl moiety of the aromatic sulfonamido group is a substituted or unsubstituted phenyl group having 6 to 10 carbon atoms or a substituted or unsubstituted naphthyl group. The heterocyclic group in the heterocyclic sulfonamido group is a 4- to 7-membered heterocyclic group containing nitrogen, sulfur or oxygen as the hetero atom, e.g., a 2-pyridyl group.

Referring to general formula (I), A can represent a yellow coupler residue (closed chain ketomethylene coupler, etc.), a magenta coupler residue (5-pyrazolone, pyrazolotriazole, pyrazoloimidazole, etc.), a cyan coupler residue (phenol, naphthol, etc.), or a colorless coupler residue (indanone, acetophenone, etc.).

The yellow coupler nucleus includes the ones described in U.S. Pat. Nos. 3,265,506, 2,875,057 and 3,408,194 and Japanese Patent Application (OPI) Nos. 48-29432, 48-66834, 54-13329 and 50-87650, for instance. The magenta coupler nucleus includes the ones described in U.S. Pat. Nos. 2,600,788, 3,062,653, 3,127,269, 3,419,391, 3,519,429 and 3,888,680 and Japanese Patent Application (OPI) Nos. 49-111631, 59-171956 and 59-162548, for instance. The cyan coupler nucleus includes the ones described in U.S. Pat. Nos. 2,474,293, 2,801,171, 3,476,563, 4,009,035 and 4,333,999, Japanese Patent Application (OPI) Nos. 50-112038, 50-117422, 55-32071 and 53-109630, *Research Disclosure* (RD), Vol. 15741, and Japanese Patent Application (OPI) No. 57-204545, for instance. The coupler nucleus which does not substantially form a dye (colorless coupler residue) includes the ones described in U.S. Pat. Nos. 3,958,993 and 3,961,959, for instance.

Furthermore, the effects of the present invention are produced with particular prominence when A in general formula (I) stands for a coupler residue of the following general formula (Cp-1), (Cp-2), (Cp-3), (Cp-4), (Cp-5), (Cp-6), (Cp-7), (Cp-8), (Cp-9), (Cp-10) or (Cp-11). These couplers are desirable in that they provide high coupling rates.

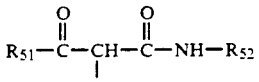
(Cp-1)

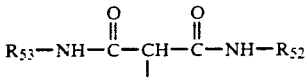
(Cp-2)

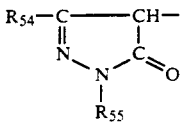
(Cp-3)

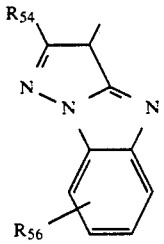
(Cp-4)

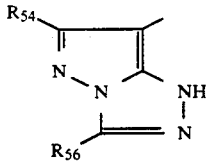
(Cp-5)

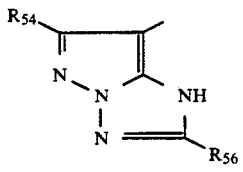
(Cp-6)

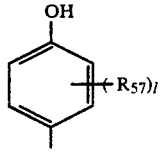
(Cp-7)

-continued

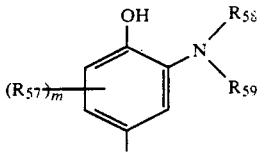
(Cp-8)

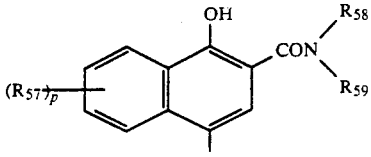
(Cp-9)

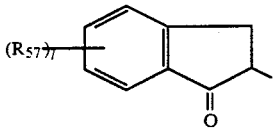
(Cp-10)

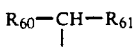
(Cp-11)

In the above formulae, the free line extends from the coupling position which is the position of attachment of the releasable group which leaves or is released in the coupling reaction. When $R_{51}$, $R_{52}$, $R_{53}$, $R_{54}$, $R_{55}$, $R_{56}$, $R_{57}$, $R_{58}$, $R_{59}$, $R_{60}$ or $R_{61}$ contain a diffusion resisting group, the total number of carbon atoms therein is selected from the range of 8 to 32, preferably 10 to 22; otherwise the total number of carbon atoms is preferably not more than 15.

$R_{51}$ through $R_{61}$ and l, m and p in the above general formulae (Cp-1) through (Cp-11) will now be explained in more detail below.

In the above formulae, $R_{51}$ is an aliphatic, aromatic, alkoxy or heterocyclic group, and $R_{52}$ and $R_{53}$ each is an aromatic or heterocyclic group.

When $R_{51}$ is an aliphatic group, $R_{51}$ preferably has 1 to 22 carbon atoms and is either substituted or unsubstituted (preferably unsubstituted), and acyclic or cyclic. Preferred substituents on the alkyl group include alkoxy, aryloxy, amino, acylamin, and halogen, and these substituents may further be substituted. Useful examples of the aliphatic group $R_{51}$ include isopropyl, isobutyl, tert-butyl, isoamyl, tert-amyl, 1,1-dimethylbutyl, 1,1-dimethylhexyl, 1,1-diethylhexyl, dodecyl, hexadecyl, octadecyl, cyclohexyl, 2-methoxyisopropyl, 2-phenoxyisopropyl, 2-p-tert-butylphenoxyisopropyl, α-aminoisopropyl, α-(diethylamino)isopropyl, α-(succinimido)isopropyl, α-(phthalimido)isopropyl, α-(benzenesulfonamido)isopropyl, and so on.

When $R_{51}$, $R_{52}$ or $R_{53}$ is an aromatic group (especially a phenyl group), this aromatic group may further be substituted. Thus, the aromatic group, such as phenyl, may be substituted by alkyl, alkenyl, alkoxy, alkoxycarbonyl, alkoxycarbonylamino, aliphatic amido, alkylsulfamoyl, alkylsulfonamido, alkylureido, or alkyl-substituted succinimido, each having at most 32 carbon atoms, and the alkyl groups may be interrupted by an aromatic divalent group such as phenylene. The phenyl group may further be substituted by aryloxy, aryloxycarbonyl, arylcarbamoyl, arylamido, arylsulfamoyl, arylsulfonamido or arylureido, and the aryl moiety of the above substituent may further be substituted by an alkyl group(s), the total number of carbon atoms in such alkyl substituent or substituents being within the range of 1 to 22.

When $R_{51}$, $R_{52}$ or $R_{53}$ is an aromatic group, e.g., a phenyl group, it may further be substituted by an amino, hydroxy, carboxy, sulfo, nitro, cyano, and/or thiocyano group, which in turn may be substituted by a lower alkyl group(s) containing 1 to 6 carbon atoms, and/or halogen.

$R_{51}$, $R_{52}$ or $R_{53}$ may further be a substituent group formed by fusion of the aromatic, e.g., phenyl group, to another ring, such as a naphthyl, quinolyl, isoquinolyl, chromanyl, coumaranyl, tetrahydronaphthyl group and so on. These substituents themselves may have substituents.

When $R_{51}$ is an alkoxy group, its alkyl moiety is a straight chain or branched chain alkyl or alkenyl group having 1 to 32, preferably 1 to 22, carbon atoms, or a cyclic alkyl or alkenyl group, which may be substituted by halogen, aryl, alkoxy, etc.

When $R_{51}$, $R_{52}$ or $R_{53}$ represents a heterocyclic group, the heterocyclic group is bound to the carbonyl carbon atom of the acyl group or the amide nitrogen atom of the α-acylacetamide through one of the carbon atoms constituting the heterocyclic group. Examples of such heterocyclic group are thiophene, furan, pyran, pyrrole, pyrazole, pyrididine, pyrazine, pyrimidine, pyridazine, indolizine, imidazole, thiazole, oxazole, triazine, thiadiazine, and oxazine. These heterocyclic groups may further be substituted.

Referring to general formula (Cp-3), $R_{55}$ represents a $C_{1-32}$ (preferably $C_{1-22}$) straight chain or branched chain alkyl (e.g., methyl, isopropyl, tertbutyl, hexyl, dodecyl, etc.) or alkenyl (e.g., allyl, etc.), cyclic alkyl (e.g., cyclopentyl, cyclohexyl, norbornyl, etc.), aralkyl (e.g., benzyl, β-phenylethyl, etc.), or cyclic alkenyl group (e.g., cyclopentenyl, cyclohexenyl, etc.). These groups may have a substituent(s) such as halogen, nitro, cyano, aryl (e.g., phenyl), alkoxy, aryloxy, carboxy, alkylthiocarbonyl, arylthiocarbonyl (e.g., phenylthiocarbonyl), alkoxycarbonyl, aryloxycarbonyl, sulfo, sulfamoyl, carbamoyl, acylamino, diacylamino, ureido, urethane, thiourethane, sulfonamido, heterocyclic (e.g., 2-pyridyl), arylsulfonyl (e.g., phenylsulfonyl), alkylsulfonyl, arylthio (e.g., phenylthio), alkylthio, alkylamino, dialkylamino, anilino, N-arylanilino (e.g., phenylanilino), N-alkylanilino, N-acylanilino, hydroxy, mercapto, and so on.

Further, $R_{55}$ may be an aryl group (e.g., phenyl, α- or β-naphthyl, etc.). The aryl group may have a substituent(s), such as alkyl, alkenyl, cyclic alkyl, aralkyl, cyclic alkenyl, halogen, nitro, cyano, aryl (e.g., phenyl), alkoxy, aryloxy, carboxy, alkoxycarbonyl, aryloxycarbonyl (e.g., phenyloxycarbonyl), sulfo, sulfamoyl, carbamoyl, acylamino, diacylamino, ureido, urethane, sulfonamido, heterocyclic (e.g., 2-pyridyl), arylsulfonyl (e.g., phenylsulfonyl), alkylsulfonyl, arylthio (e.g., phenylthio), alkylthio, alkylamino, dialkylamino, anilino, N-alkylanilino, N-arylanilino (e.g., N-phenylanilino), N-acylanilino, hydroxy, and so on, preferably halogen and alkyl.

$R_{55}$ may be a heterocyclic group (for example, 5- to 6-membered heterocyclic or condensed heterocyclic groups containing hetero atoms such as nitrogen, oxygen and sulfur atoms, e.g., 4-pyridyl, quinolyl, furyl, benzothiazolyl, oxazolyl, imidazolyl, naphthoxazolyl, etc.), a heterocyclic group substituted by a substituent(s) metnioned for the aryl group, an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

In the above formulae, $R_{54}$ is a hydrogen atom, a $C_{1-32}$ (preferably $C_{1-22}$) straight chain or branched chain alkyl or alkenyl group, a cyclic alkyl group, an aralkyl group or a cyclic alkenyl group (these groups may have such substituents as mentioned above for $R_{55}$), an aryl group (e.g., phenyl) or a heterocyclic group (e.g., 2-pyridyl) (these groups may have substituents as mentioned above for $R_{55}$), an alkoxycarbonyl group (e.g., methoxycarbonyl, ethoxycarbonyl, stearyloxycarbonyl, etc.), an aryloxycarbonyl group (e.g., phenoxycarbonyl, naphthoxycarbonyl, etc.), an aralkyloxycarbonyl group (e.g., benzyloxycarbonyl, etc.), an alkoxy group (e.g., methoxy, ethoxy, heptadecyloxy, etc.), an aryloxy group (e.g., phenoxy, tolyloxy, etc.), an alkylthio group (e.g., ethylthio, dodecylthio, etc.), an arylthio group (e.g., phenylthio, α-naphthylthio, etc.), a carboxy group, an acylamino group (e.g., acetylamino, 3-[(2,4-di-tert-amylphenoxy)acetamido]benzamido, etc.), a diacylamino group, an N-alkylacylamino group (e.g., N-methylpropionamido, etc.), an N-arylacylamino group (e.g., N-phenylacetamido, etc.), a ureido group (e.g., ureido, N-arylureido, N-alkylureido, etc.), a urethane group, a thiourethane group, an arylamino group (e.g., phenylamino, N-methylanilino, diphenylamino, N-acetylanilino, 2-chloro-5-tetradecanamidoanilino, etc.), an alkylamino group (e.g., n-butylamino, methylamino, cyclohexylamino, etc.), a cycloamino group (e.g., piperidino, pyrrolidino, etc.), a heterocyclic amino group (e.g., 4-pyridylamino, 2-benzoxazolylamino, etc.), an alkylcarbonyl group (e.g., methylcarbonyl, etc.), an arylcarbonyl group (e.g., phenylcarbonyl, etc.), a sulfonamido group (e.g., alkylsulfonamido, arylsulfonamido, etc.), a carbamoyl group (e.g., ethylcarbamoyl, dimethylcarbamoyl, N-methylphenylcarbamoyl, N-phenylcarbamoyl, etc.), a sulfamoyl group (e.g., N-alkylsulfamoyl, N,N-dialkylsulfamoyl, N-arylsulfamoyl, N-alkyl-N-arylsulfamoyl, N,N-diarylsulfamoyl, etc.), a cyano group, a hydroxy group, or a sulfo group.

In the above formulae, $R_{56}$ is a hydrogen atom or a $C_{1-32}$ (preferably $C_{1-22}$) straight chain or branched chain alkyl or alkenyl, cyclic alkyl, aralkyl or cyclic alkenyl group. These groups may have one or more substituents such as those mentioned above for $R_{55}$.

$R_{56}$ may also be an aryl group (e.g., phenyl) or a heterocyclic group (e.g., 2-pyridyl), which may have substituents such as those mentioned for $R_{55}$.

Further, $R_{56}$ may be any of cyano, alkoxy, aryloxy, halogen, carboxy, alkoxycarbonyl, aryloxycarbonyl (e.g., phenyloxycarbonyl), acyloxy, sulfo, sulfamoyl, carbamoyl, acylamino, diacylamino, ureido, urethane, sulfonamido, arylsulfonyl (e.g., phenylsulfonyl), alkylsulfonyl, arylthio, alkylthio, alkylamino, dialkylamino, anilino, N-arylanilino (e.g., N-phenylanilino), N-alkylanilino, N-acylanilino and hydroxy.

$R_{57}$, $R_{58}$ and $R_{59}$ each is a group as is used in conventional 4-equivalent phenol or α-naphthol couplers. Thus, $R_{57}$ may, for example, be a hydrogen atom, a halogen atom, an alkoxycarbonylamino group, an aliphatic hydrocarbon residue, an N-arylureido group (e.g., an N-phenylureido group), an acylamino group, —O—$R_{62}$ or —S—$R_{62}$ (where $R_{62}$ is an aliphatic hydrocarbon residue), and when $R_{57}$ occurs 2 or more times in the same molecule, the same may represent different species. The aliphatic hydrocarbon residue may also be substituted. When the substituent(s) contains an aryl group, the aryl group may have substituents such as alkyl, alkenyl, cyclic alkyl, aralkyl, cyclic alkenyl, halogen. nitro, cyano, aryl (e.g., phenyl), alkoxy, aryloxy, carboxy, alkoxycarbonyl, aryloxycarbonyl (e.g., phenyloxycarbonyl), sulfo, sulfamoyl, carbamoyl, acylamino, diacylamino, ureido, urethane, sulfonamido, heterocyclic (e.g., 2-pyridyl), arylsulfonyl (e.g., phenylsulfonyl), alkylsulfonyl, arylthio (e.g., phenylthio), alkylthio, alkylamino, dialkylamino, anilino, N-alkylanilino, N-arylanilino (e.g., N-phenylanilino), N-acylanilino, hydroxy, and so on, preferably halogen and alkyl, as mentioned for $R_{55}$.

As to $R_{58}$ and $R_{59}$, examples thereof include groups selected from aliphatic hydrocarbon residues, aryl groups and heterocyclic residues. In addition, one of $R_{58}$ and $R_{59}$ may be a hydrogen atom, and the groups mentioned above may have a substituent(s). Further, $R_{58}$ and $R_{59}$ may, taken together, represent a nitrogen-containing heterocyclic nucleus.

The aliphatic hydrocarbon residues mentioned above for $R_{57}$, $R_{58}$ and $R_{59}$ may be either saturated or unsaturated and either straight chain, branched chain, or cyclic. Preferred examples are alkyl groups (e.g., methyl, ethyl, propyl, isopropyl, butyl, t-butyl, isobutyl, dodecyl, octadecyl, cyclobutyl, cyclohexyl, etc.), and alkenyl groups (e.g., allyl, octenyl, etc.).

As examples of the aryl group for $R_{58}$ and $R_{59}$, there may be mentioned phenyl, naphthyl and so on, and as typical examples of the heterocyclic residue for $R_{58}$ and $R_{59}$, there may be mentioned pyridinyl, quinolyl, thienyl. piperidyl, imidazolyl and so on. The substituents which can be introduced into the aliphatic hydrocarbon residue, aryl group or heterocyclic residue for $R_{58}$ and $R_{59}$ include halogen, nitro, hydroxy, carboxy, amino, substituted amino, sulfo, alkyl, alkenyl, aryl, heterocyclic (e.g., 2-pyridyl), alkoxy, aryloxy, arylthio, arylazo, acylamino, carbamoyl, alkoxycarbonyl, acyl, acyloxy, sulfonamido, sulfamoyl, sulfonyl and morpholino groups and so on.

In the above formulae, l is an integer of 1 to 4, m is an integer of 1 to 3 and p is an integer of 1 to 5.

$R_{60}$ is an arylcarbonyl group, an alkanoyl group of 2 to 32. preferably 2 to 22, carbon atoms, an arylcarbamoyl group (e.g., a phenylcarbamoyl group), an alkanecarbamoyl group of 2 to 32, preferably 2 to 22, carbon atoms, an alkoxycarbonyl group of 1 to 32, preferably 2 to 22, carbon atoms, or an aryloxycarbonyl group (e.g., a phenyloxycarbonyl group). These groups may have a substituent(s), and as examples of such substituents, there may be mentioned alkoxy groups, alkoxycarbonyl groups, acylamino groups, alkylsulfamoyl groups, alkylsulfonamido groups, alkylsuccinimido groups, halogen atoms, nitro groups, carboxy groups, nitrilo groups, alkyl groups, aryl groups (e.g., phenyl groups) and so on.

$R_{61}$ is an arylcarbonyl group (e.g., a phenylcarbonyl group), an alkanoyl group of 2 to 32, preferably 2 to 22, carbon atoms, an arylcarbamoyl group, an alkanecarbamoyl group of 2 to 32, preferably 2 to 22, carbon atoms, an alkoxycarbonyl or aryloxycarbonyl group of 1 to 32, preferably 1 to 22, carbon atoms, an alkylsulfonyl group of 1 to 32, preferably 1 to 22, carbon atoms, an arylsulfonyl group (e.g., a phenylsulfonyl group), an aryl group (e.g., a phenyl group), or a 5- or 6-membered heterocyclic group (e.g., a 2-pyridyl group), where the hetero atom or atoms is/are selected from among N, O and S, e.g., a triazolyl, imidazolyl, phthalimido, succinimido, furyl, pyridyl, or benzotriazolyl group. These groups may have a substituent(s) such as hereinbefore exemplified for $R_{60}$.

Among the above mentioned coupler residues. the yellow coupler residue is preferably one where, in general formula (Cp-1), $R_{51}$ is a t-butyl group or a substituted or unsubstituted aryl group and $R_{52}$ is a substituted or unsubstituted aryl group or, in general formula (Cp-2), $R_{52}$ and $R_{53}$ each is a substituted or unsubstituted aryl group.

The preferred magenta coupler residue is one where, in general formula (Cp-3), $R_{54}$ is an acylamino, ureido or arylamino group and $R_{55}$ is a substituted aryl group; in general formula (Cp-4), $R_{54}$ is an acylamino, ureido or arylamino group and $R_{56}$ is a hydrogen atom; or in general formula (Cp-5) or (Cp-6), $R_{54}$ and $R_{56}$ each is a straight chain or branched chain alkyl or alkenyl, cyclic alkyl, aralkyl or cyclic alkenyl group.

The preferred cyan coupler residue is one where, in general formula (Cp-7), $R_{57}$ is an acylamino or ureido group at the 2-position, an acylamino or alkyl group at the 5-position and a hydrogen or chlorine atom at the 6-position. or in general formula (Cp-9), $R_{57}$ is a hydrogen atom or an acylamino, sulfonamido or alkoxycarbonyl group at the 5-position, $R_{58}$ is a hydrogen atom, and $R_{59}$ is a phenyl, alkyl, alkenyl, cyclic alkyl, aralkyl or cyclic alkenyl group.

The preferred colorless coupler residue is one where, in general formula (Cp-10), $R_{57}$ is an acylamino, sulfonamido or sulfamoyl group, or in general formula (Cp-11), $R_{60}$ and $R_{61}$ each is an alkoxycarbonyl group.

Included in the couplers are the cases in which a bis-compound or a polymer is formed at any of $R_{51}$ through $R_{61}$, and such may be a polymer of a monomer containing ethylenic unsaturation or a copolymer of such a monomer with one or more non-chromogenic monomers.

When the coupler residue in the present invention is a polymer, it is a polymer having a repeating unit of general formula (Cp-13) as derived from a monomeric coupler of the following general formula (Cp-12) or a copolymer thereof with one or more non-chromogenic monomers containing at least one ethylene group which cannot undergo coupling with an oxidized aromatic primary amine developing agent.

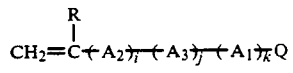

(Cp-12)

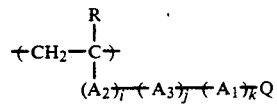

(Cp-13)

In the above formulae, R is a hydrogen atom, a lower alkyl group having 1 to 4 carbon atoms, or a chlorine atom; $A_1$ is —CONR'—, NR'CONR'—, —NR'COO—, —COO—, —$SO_2$—, —CO—, —NR'CO—, —$SO_2$NR'—, —NR'$SO_2$—, —OCO—, —OCONR'—, —NR'— or —O—; $A_2$ is —CONR'— or —COO—; R' is a hydrogen atom, an aliphatic group (preferably $C_1$ to $C_{12}$) or an aryl group (e.g., a phenyl group), and when R' occurs 2 or more times, the R' groups may represent the same or different species. $A_3$ is a substituted or unsubstituted alkylene group having 1 to 10 carbon atoms, an aralkylene group, or a substituted or unsubstituted arylene group (e.g., a phenylene group). The alkylene group may be either straight chain or branched chain.

As examples of the alkylene group, there may be mentioned methylene, methylmethylene, dimethylmethylene, dimethylene, trimethylene, tetramethylene, pentamethylene, hexamethylene, and decylmethylene; as an example of the aralkylene group, benzylidene may be mentioned; and examples of the arylene group include phenylene and naphthylene.

Q is a group derived from the coupler residue of any of general formulae (Cp-1) through (Cp-11) and it can be attached at any of $R_{51}$ through $R_{61}$.

i, j and k each is 0 or 1.

The substituents on the alkylene, aralkylene or arylene group represented by $A_3$ include aryl (e.g., phenyl), nitro, hydroxy, cyano, sulfo, alkoxy (e.g., methoxy), aryloxy (e.g., phenoxy), acyloxy (e.g., acetoxy), acylamino (e.g., acetylamino), sulfonamido (e.g., methanesulfonamido), sulfamoyl (e.g., methylsulfamoyl), halogen (e.g., fluorine, chlorine, bromine, etc.), carboxy, carbamoyl (e.g., methylcarbamoyl), alkoxycarbonyl (e.g., methoxycarbonyl), and sulfonyl (e.g., methylsulfonyl). When two or more substituents are present, the substituents may be either the same or different.

The non-chromogenic ethylenically unsaturated monomers (having an ethylene group) which do not undergo a coupling reaction with the oxidation product of an aromatic primary amine developing agent include, among others, acrylic acid, α-chloroacrylic acid, α-alkylacrylic acid (e.g., methacrylic acid, etc.) and esters or amides derived from these acrylic acids (e.g., acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate and β-hydroxy methacrylate), methylenedibisacrylamide, vinyl esters (e.g., vinyl acetate, vinyl propionate and vinyl laurate), acrylonitrile, methacrylonitrile, aromatic vinyl compounds (e.g., styrene and derivatives thereof, vinyltoluene, divinylbenzene, vinylacetophenone and sulfostyrene), itaconic acid, citraconic acid, crotonic acid, vinylidene chloride, vinyl alkyl (preferably $C_2$ and $C_4$) ethers (e.g., vinyl ethyl ether), maleic acid, maleic anhydride, maleic acid esters, N-vinyl-2-pyrrolidone, N-vinylpyridine, 2- and 4-vinylpyridines, and the like. The non-chromogenic ethylenically unsaturated monomers may be used in a combination of two or more species. Thus, combinations of n-butyl acrylate with methyl acrylate, styrene with methacrylic acid, methacrylic acid with acrylamide, and methyl acrylate with diacetoneacrylamide may be mentioned by way of example.

The following is a partial listing of the compounds (a) and (b) employed in the practice of the present invention. It should be understood that the present invention is by no means limited to the use of these specific compounds.

(1)

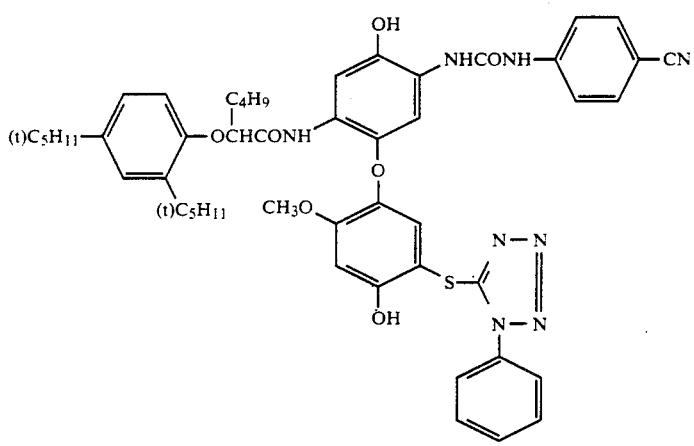

(2)

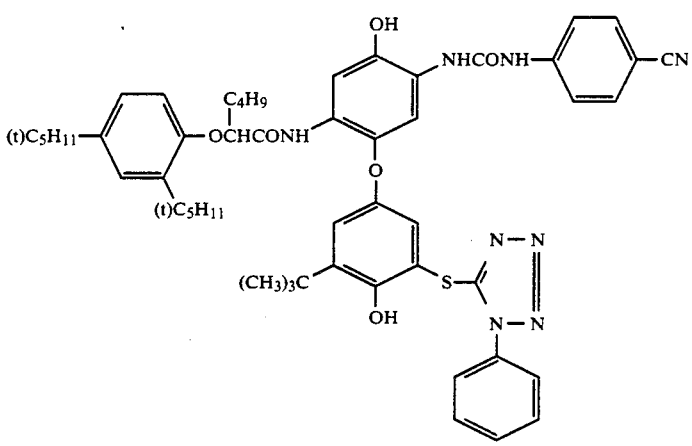

-continued
(3)
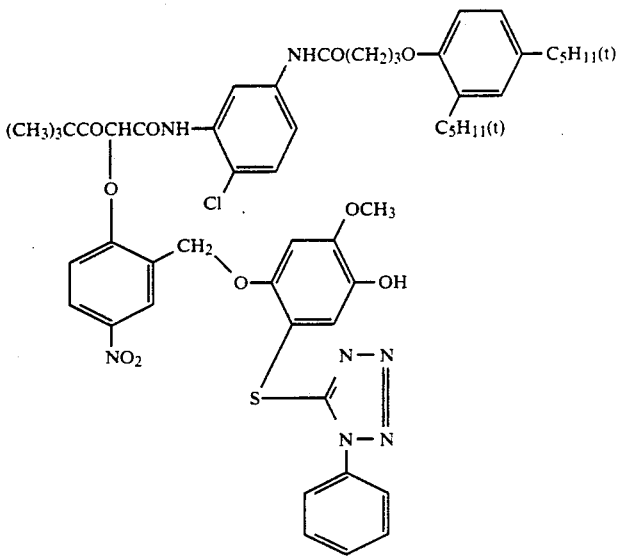
(4)
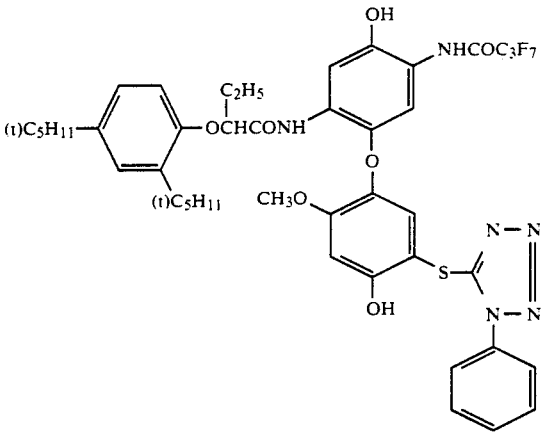
(5)
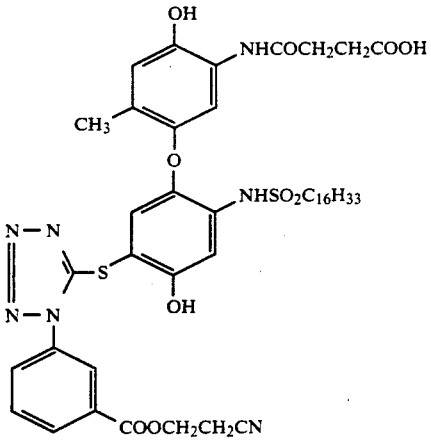

-continued
(6)
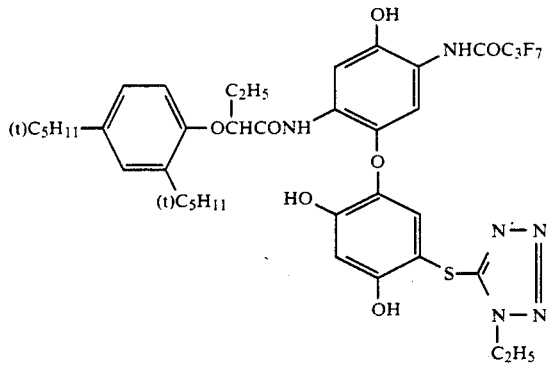
(7)
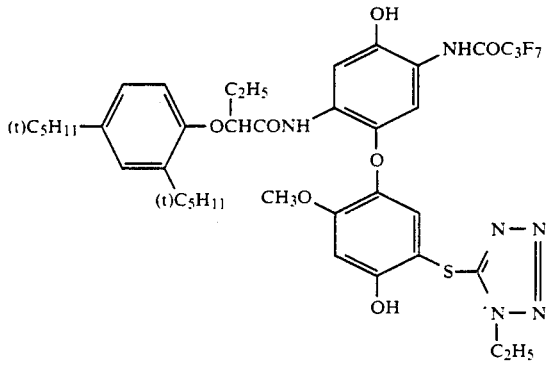
(8)
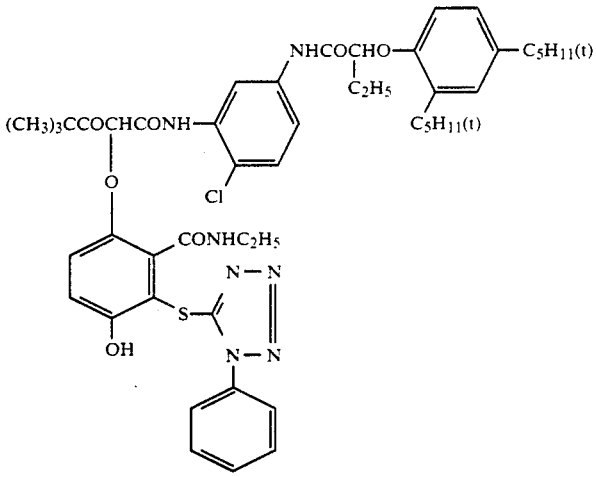
(9)
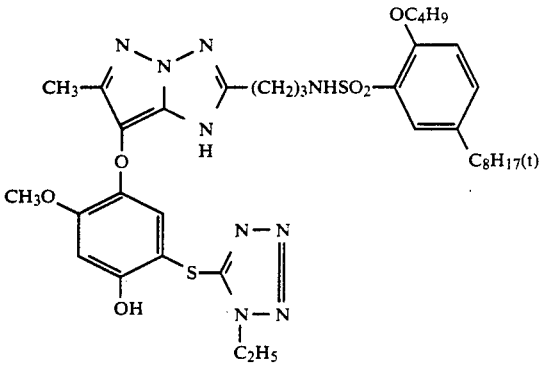

-continued
(10)
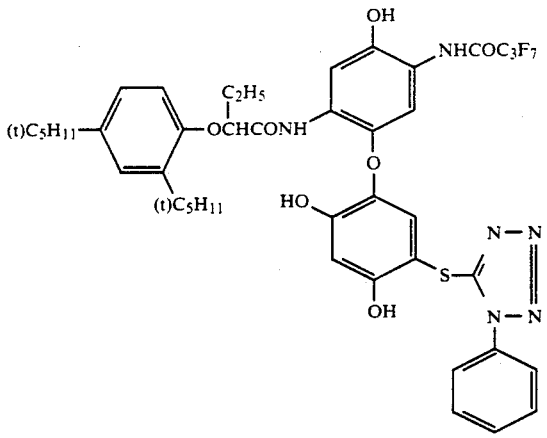
(11)
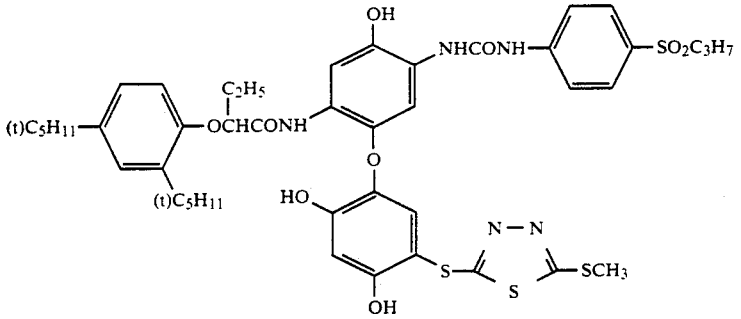
(12)
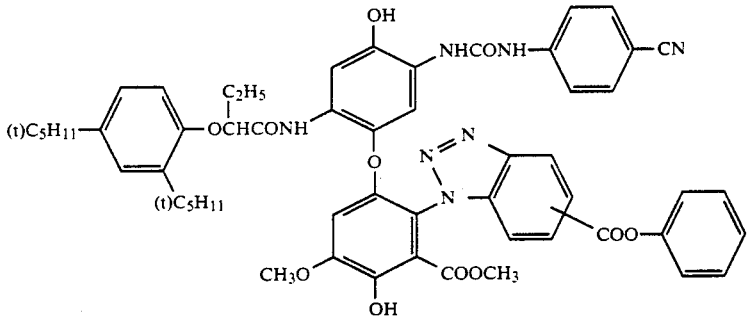
(13)
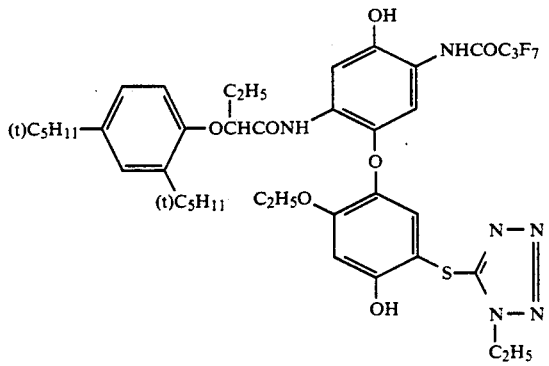

-continued
(14)
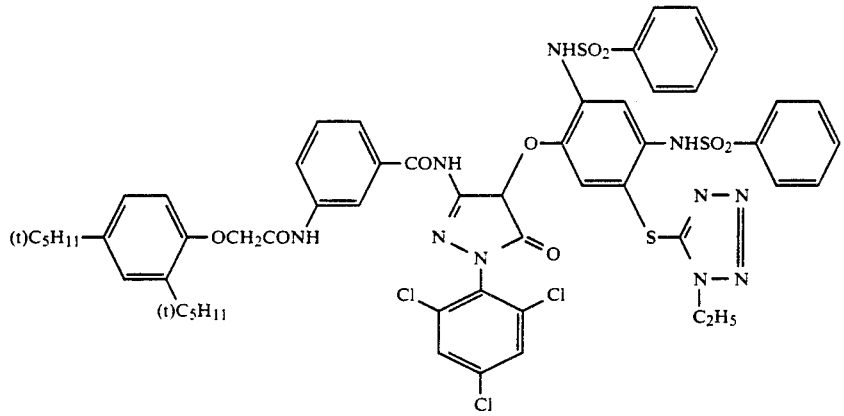
(15)
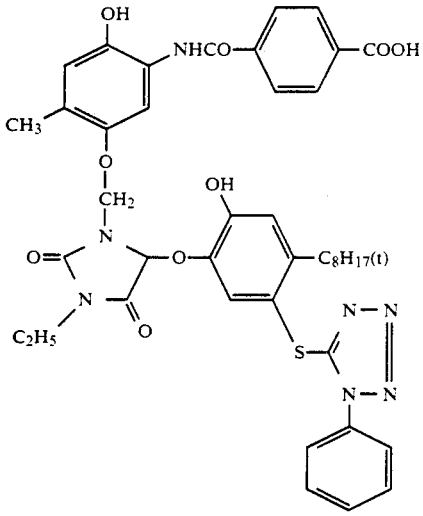
(16)
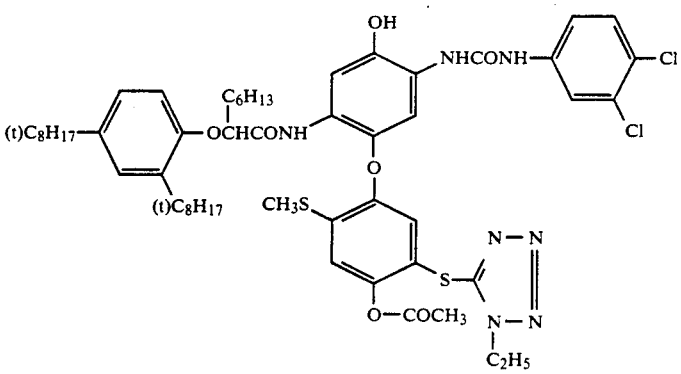

-continued
(17)
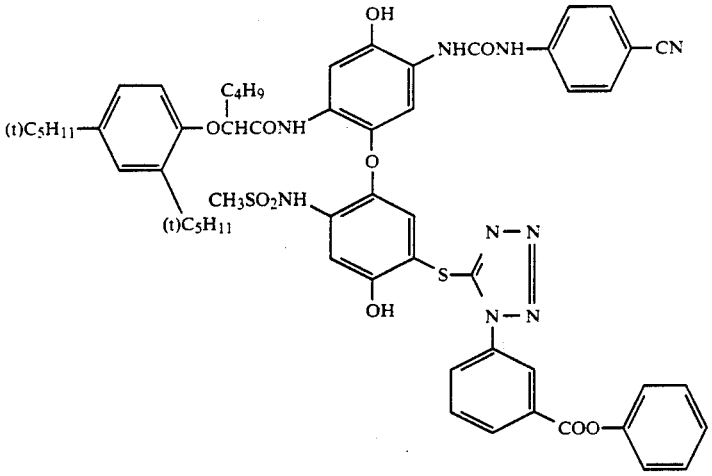
(18)
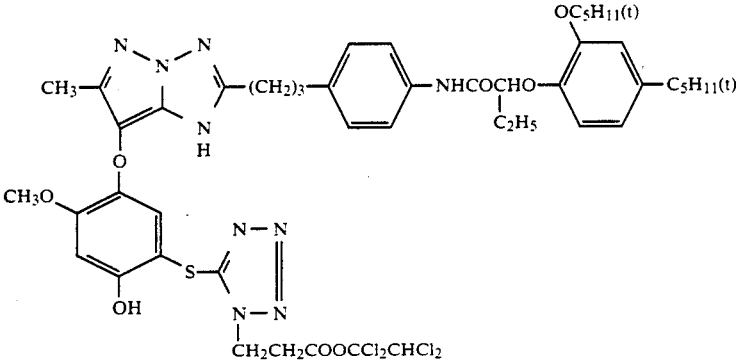
(19)
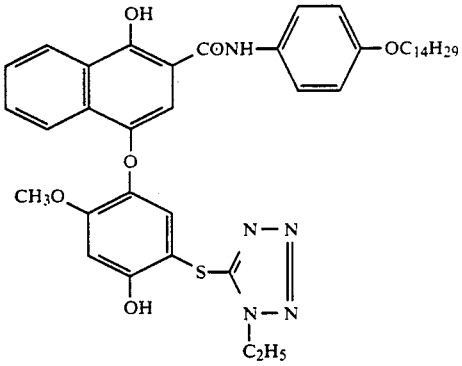
(20)
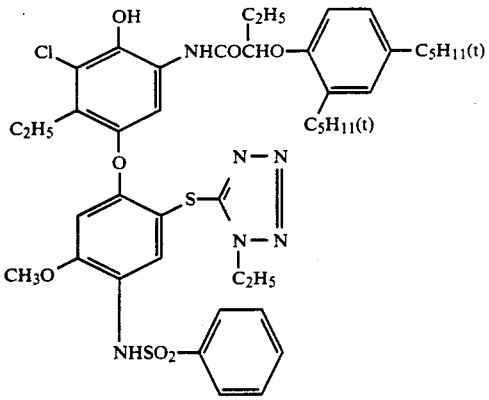

-continued
(21)
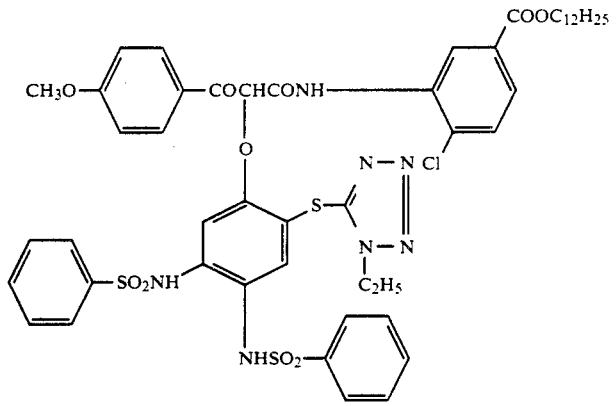
(22)
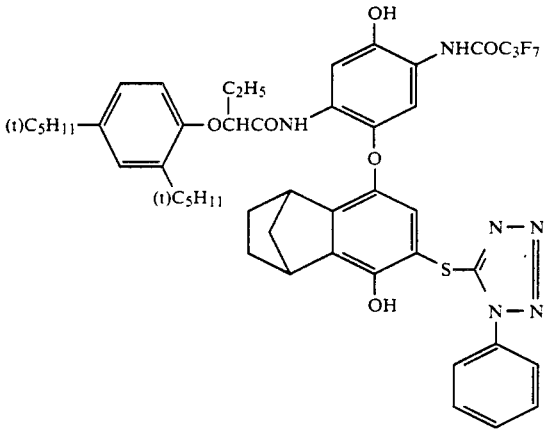
(23)
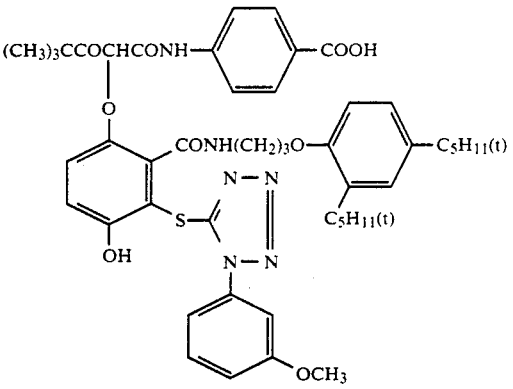
(24)
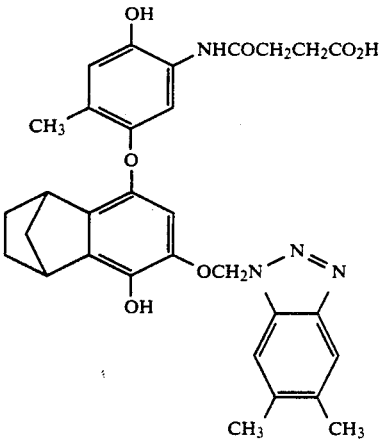

-continued
(25)
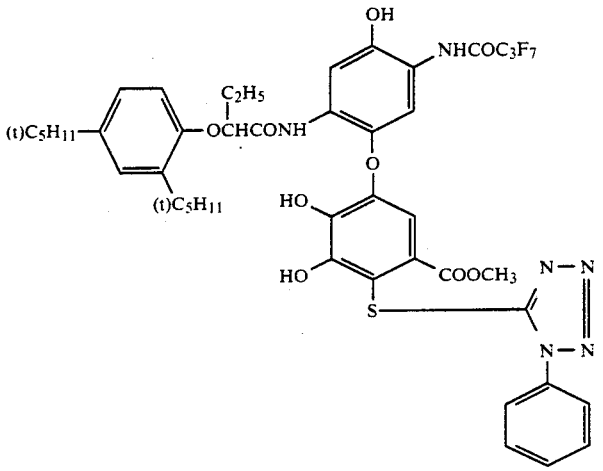
(26)
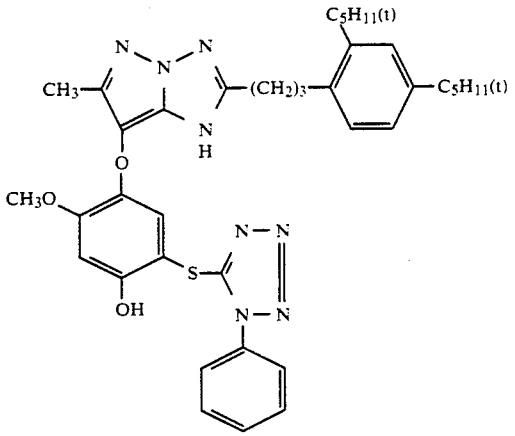
(27)
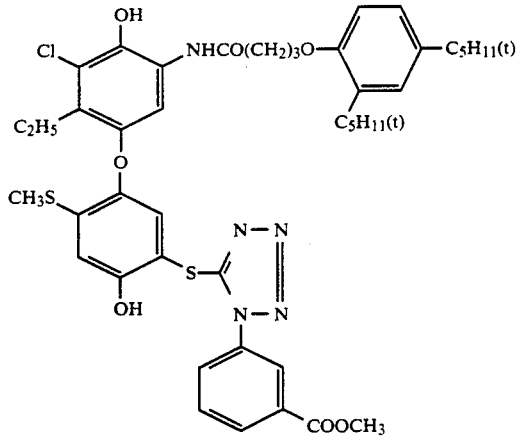

-continued
(28)
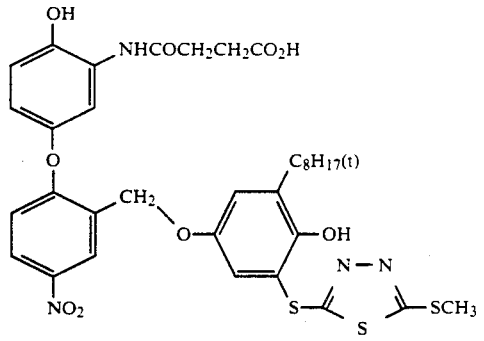
(29)
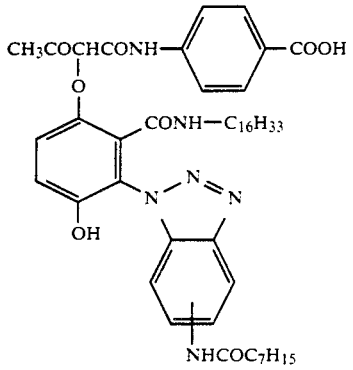
(30)
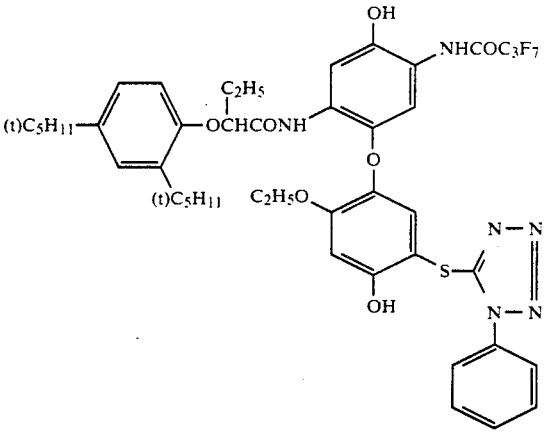
(31)
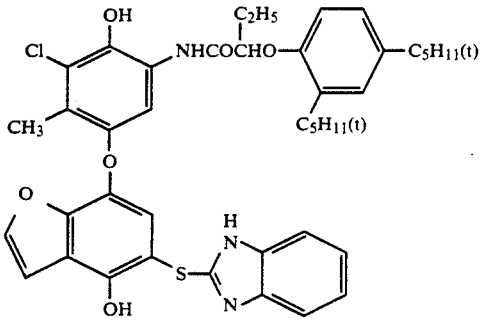

-continued
(32)
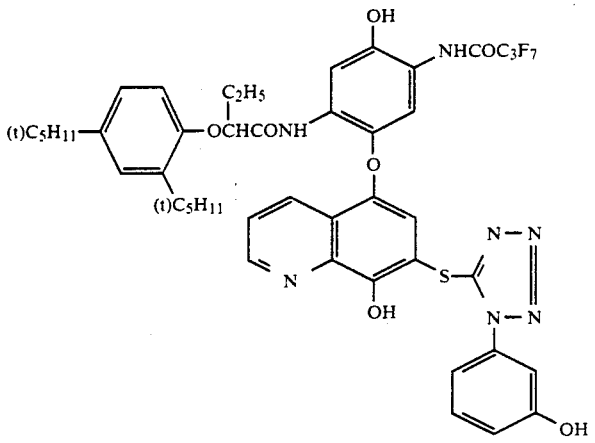
(33)
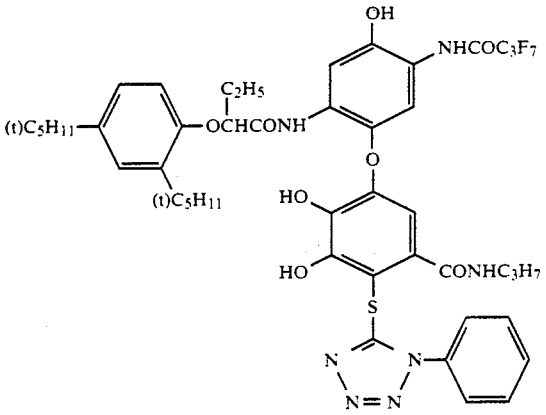
(34)
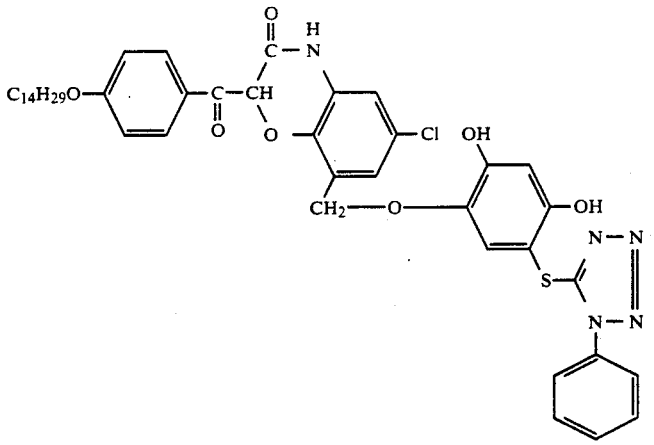

-continued (35)

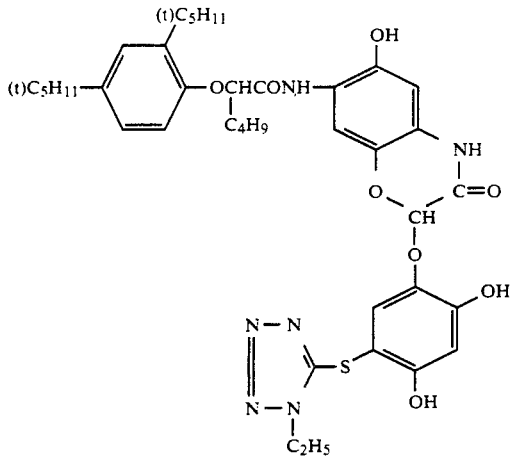

(36)

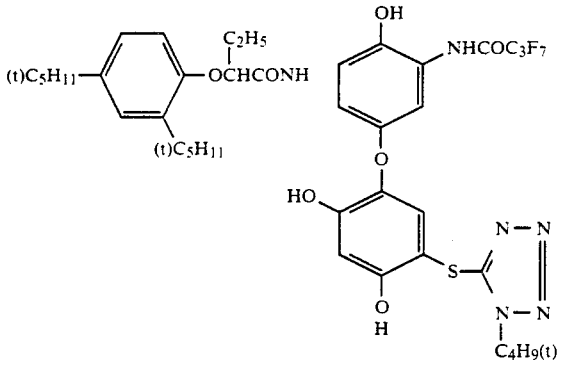

The compounds represented by general formula (I) can be synthesized by the methods described in Japanese Patent Application Nos. 33059/84 and 136973/84 (corresponding to European Patent 0157146A2 and Japanese Patent Application (OPI) No. 15142/86, respectively), U.S. Pat. No. 4,248,962, British Patent (published) 2,072,363, and Japanese Patent Application Nos. 72378/85 and 72379/85 by Fuji Photo Film Co., Ltd. filed Apr. 5, 1985, Japanese Patent Application No. 75040/85 by Fuji Photo Film Co., Ltd. filed Apr. 8, 1985, Japanese Patent Application No. 78013/85 by Fuji Photo Film Co., Ltd. filed Apr. 12, 1985, and Japanese Patent Application No. 80021/85 by Fuji Photo Film Co., Ltd. filed Apr. 15, 1985.

In the following, examples of the synthesis of the compound of the present invention are set forth. Other compounds can be prepared in synthesis similar to the following synthesis.

Synthesis (1)

Synthesis of Illustrative Compound (4)

The illustrative Compound (4) was prepared by the following synthesis:

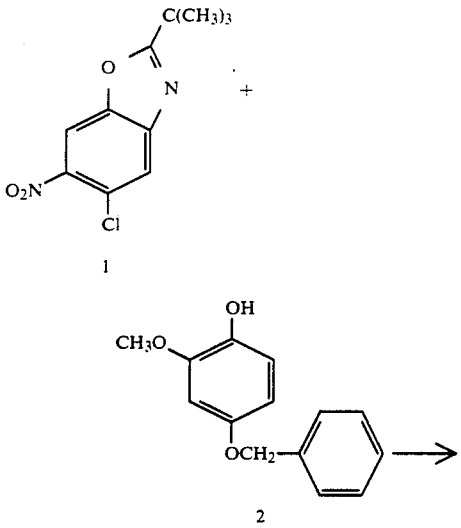

-continued

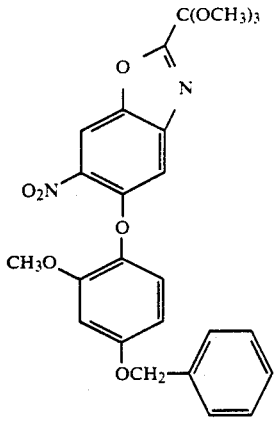

3

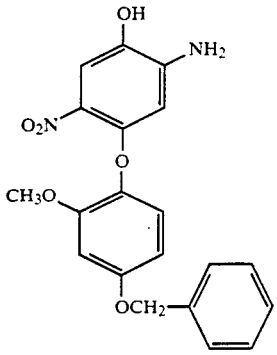

4

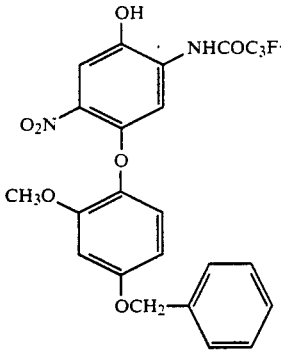

5

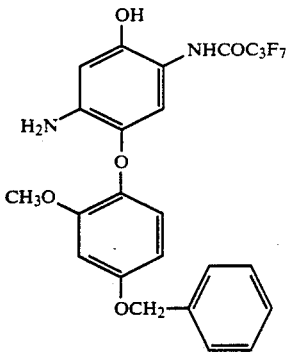

6

-continued

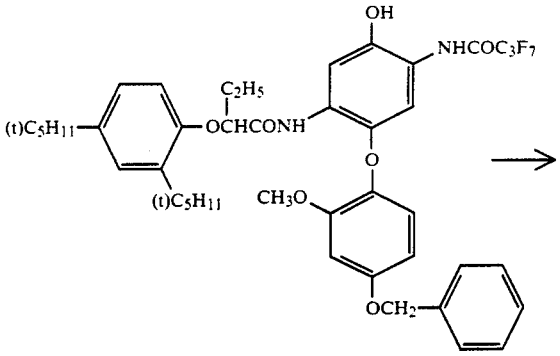

7

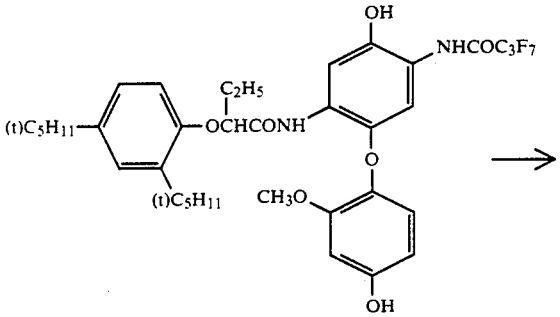

8

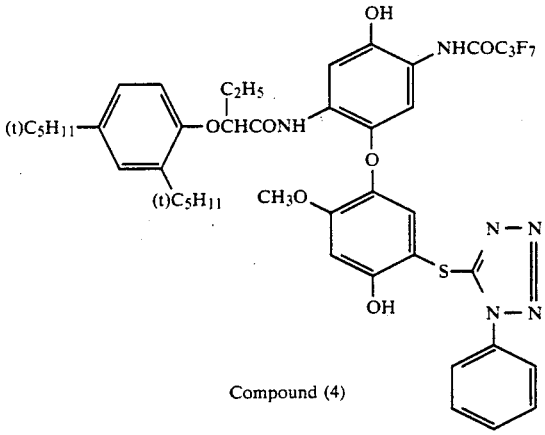

Compound (4)

Step 1

Synthesis of Intermediate Compound 3

62 g of the compound 2, 18 g of caustic soda and 10 ml of water were added to 700 ml of toluene. The admixture was heated under reflux in an atmosphere of nitrogen for 1 hour. From the reaction solution were distilled off water and toluene as azeotropic mixture. To the residue was added 200 ml of N,N-dimethylformamide and the admixture was heated at a temperature of 100° C. To the heated admixture was added 57 g of the compound 1. After the admixture underwent a reaction at a temperature of 100° C. for 1 hour, the reaction solution was allowed to cool down to room temperature and then ethyl acetate was added to the cooled solution. The solution was transferred to a separating funnel and it was washed with water. After the ethyl acetate phase was separated, the solvent was removed under reduced pressure to obtain 53 g of the oil residue containing, as a main component, the compound 3.

Step 2

Synthesis of Intermediate Compound 4

53 g of the compound 3 which had been prepared in Step 1 was dissolved in a mixed solvent of 400 ml of ethanol and 120 ml of water. 40 g of potassium hydroxide was added to the solution. After the solution was heated under reflux for 4 hours, the reaction solution was mixed with hydrochloric acid until neutralization was reached. The neutralized solution was then transferred to a separating funnel together with ethyl acetate and water. After the ethyl acetate phase was separated, the solvent was distilled off to obtain 43 g of the oil residue containing, as a main component, the compound 4.

Step 3

Synthesis of Intermediate Compound 5

43 g of the compound 4 which had been prepared in Step 2 was dissolved in 300 ml of ethyl acetate. 69 g of anhydrous heptafluoropropionic acid was dropwise added to the solution at room temperature. After the solution underwent a reaction for 30 minutes, to the reaction solution was added water. The solution was then transferred to a separating funnel and it was washed with water. After the oil phase was separated, the solvent was distilled off. The residue was column chromatographed to isolate and purify the objective compound on silica gel with 2.5% ethanol-containing chloroform eluents. 47 g of oil compound 5 was obtained.

Step 4

Synthesis of Intermediate Compound 6

47 g of the compound 5 which had been prepared in Step 3, 36.3 g of iron filings and 10 ml of acetic acid were added to a mixed solvent of 40 ml of water and 400 ml of isopropanol. The admixture was heated under reflux for 1 hour. While the solution thus refluxed was hot, it was filtered. The filtrate was concentrated until the amount thereof became about a half. The crystals thus precipitated were filtered off to obtain 44 g of the compound 6.

Step 5

Synthesis of Intermediate Compound 7

44 g of the compound 6 which had been prepared in Step 4 was added to 400 ml of acetonitrile and the admixture was heated under reflux. 28 g of 2-(2,4-di-t-amylphenoxy)butanoyl chloride was added dropwise to the refluxed admixture. After the solution was heated under reflux for 30 minutes, it was allowed to cool down to room temperature. Ethyl acetate was added to the reaction solution. The reaction solution was then transferred to a separating funnel and it was washed with water. After the oil phase was separated, the solvent was distilled off under reduced pressure. The residue was recrystallized from acetonitrile to obtain 60 g of the compound 7.

Step 6

Synthesis of Intermediate Compound 8

60 g of the compound 7 which had been prepared in Step 5 was added to 500 ml of dichloromethane. The admixture was cooled to a temperature of −10° C. 34.5 g of boron tribromide was dropwise added to the cooled admixture. After the admixture underwent a reaction at a temperature of −5° C. or less for 20 minutes, an aqueous solution of sodium carbonate was dropwise added thereto until neutralization was reached. The neutralized solution was transferred to a separating funnel and it was washed with water. After the oil phase was separated, the solvent was removed under reduced pressure. The residue was recrystallized from acetonitrile to obtain 45.2 g of the compound 8.

Step 7

Synthesis of the Illustrative Compound (4)

45.2 g of the compound 8 which had been prepared in Step 6 was added to 600 ml of acetonitrile. To the admixture was dropwise added 100 ml of chloroform solution containing 20.2 g of 1-phenyltetrazolyl-5-sulfonyl chloride at room temperature (25° C.). To the reaction solution was added ethyl acetate. The solution was transferred to a separating funnel and it was washed with water. After the oil phase was separated, the solvent was distilled off. The residue was recrystallized from a mixed solvent of hexane and ethyl acetate to obtain 45.3 g of the desired illustrative Compound (4). The melting point thereof was 201° to 202° C.

Synthesis (2)

Synthesis of Illustrative Compound (33)

The illustrative Compound (33) was prepared by the following synthesis:

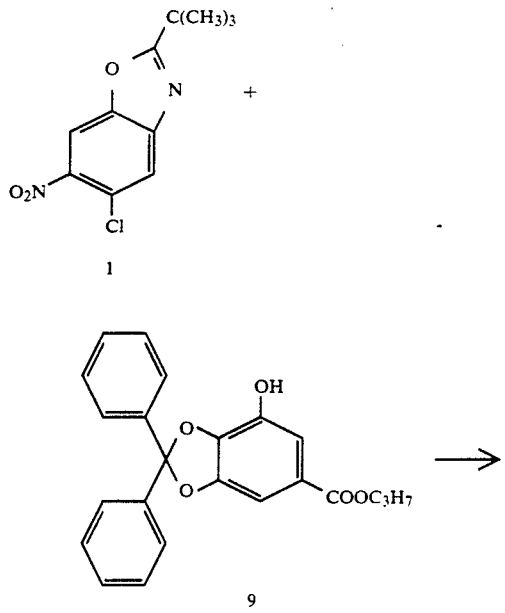

-continued
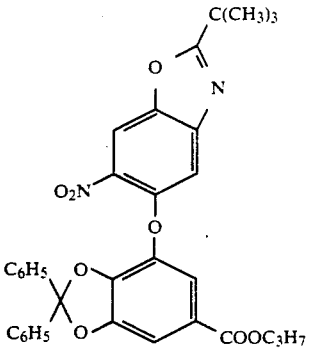
10
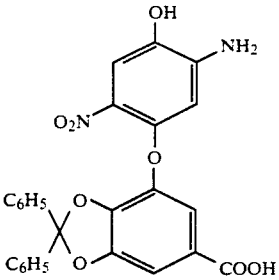
11
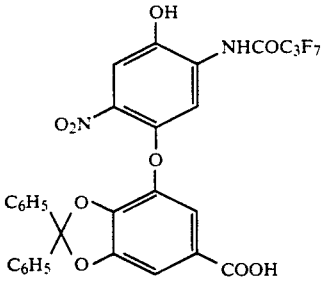
12
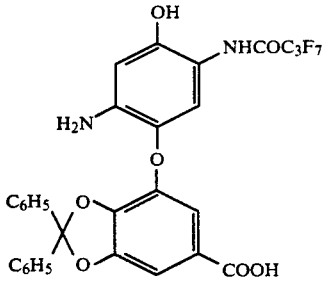
13
-continued
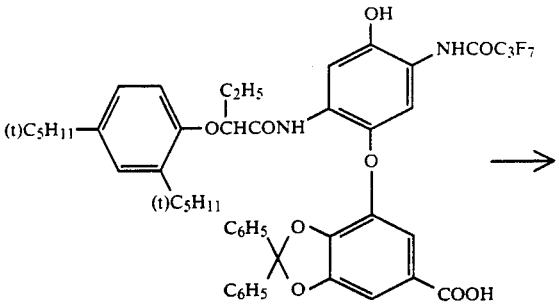
14
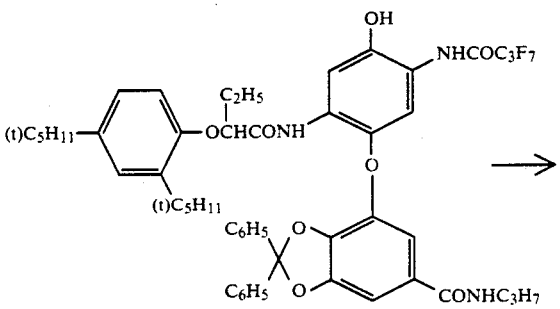
15
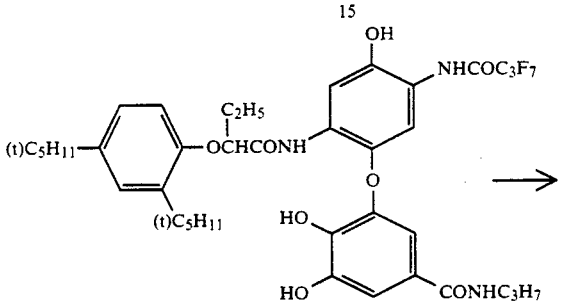
16
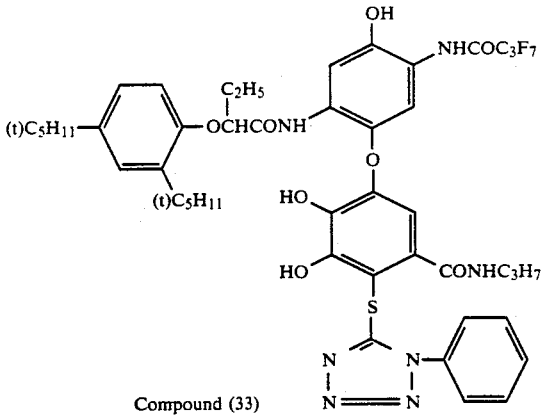
Compound (33)
Step 1
Synthesis of Intermediate Compound 10
147.7 g of the compound 9 (which had been prepared in the same manner as described in *J. Am. Chem. Soc.*, 81, 4606 (1959)), 24.6 g of potassium hydroxide and 15 ml of water were added to 1 liter of toluene. The admixture was heated under reflux for 1 hour. From the reaction solution were distilled off water and toluene as azeotropic mixture. To the residue were added 500 ml of N,N-dimethylformamide, 70 g of the compound 1, 0.5 g of cuprous chloride and the solution underwent a reaction at a temperature of 120° C. for 4 hours. After the reaction solution was allowed to cool down to room temperature, 12 ml of hydrochloric acid, 150 ml of water and 500 ml of methanol were added thereto. The crystals thus precipitated were filtered off to obtain 120 g of the compound 10.

Step 2

Synthesis of Intermediate Compound 11

55.9 g of the compound 10 which had been prepared in Step 1 was added to a mixed solvent of 300 ml of ethanol and 100 ml of water. The admixture was then purged by bubbling with nitrogen gas. 31.4 g of potassium hydroxide was added to the solution and then heated under reflux for 6 hours. The solution thus refluxed was allowed to cool down to room temperature and mixed with hydrochloric acid until neutralization was reached. 500 ml of ethyl acetate was added to the solution thus neutralized. and the solution was transferred to a separating funnel. The solution was washed with water. After the oil phase was separated, the solvent was removed under reduced pressure. All the residue (46.2 g) was used in the subsequent step.

Step 3

Synthesis of Intermediate Compound 12

46.2 g of the compound 11 which had been prepared in Step 2 was dissolved in 500 ml of ethyl acetate. 47.3 g of anhydrous heptafluorobutanoic acid was added dropwise to the solution at room temperature. After the solution underwent a reaction at room temperature for 40 minutes, the reaction solution was mixed with an aqueous solution of sodium carbonate until neutralization was reached. The reaction solution was then transferred to a separating funnel where the oil phase was separated and washed with water. After the oil phase was separated, the solvent was removed under reduced pressure. Chloroform was added to the residue so that crystals precipitated. The crystals thus precipitated were filtered off, and the filtrate was then concentrated to obtain 52.5 g of the compound 12 which was all used in the subsequent step.

Step 4

Synthesis of Intermediate Compound 13

52.5 g of the compound 12 which had been prepared in Step 3, 53 g of reduced iron, 3 g of ammonium chloride, and 3 ml of acetic acid were added to a mixed solvent of 280 ml of isopropanol and 40 ml of water. The admixture was heated under reflux for 1 hour. While the solution thus refluxed was hot, it was filtered. The filtrate was concentrated under reduced pressure until crystals precipitated. The filtrate thus concentrated was cooled. The crystals were filtered off to obtain 45.2 g of the compound 13.

Step 5

Synthesis of Intermediate Compound 14

45.2 g of the compound 13 was added to 500 ml of acetonitrile. 28.3 g of 2-(2,4-di-t-amylphenoxy)butanoyl chloride was added dropwise to the admixture while it was heated under reflux. After the mixture underwent a reaction under reflux for 30 minutes, it was allowed to cool down to room temperature. 500 ml of ethyl acetate was added to the reaction solution. The reaction solution was then washed with water. After the oil phase was separated, the solvent was removed under reduced pressure. The residue was recrystallized from ethyl acetate and n-hexane to obtain 56.7 g of the compound 14.

Step 6

Synthesis of Intermediate Compound 15

56.7 g of the compound 14 which had been prepared in Step 5 was added to a mixed solvent of 250 ml of tetrahydrofuran, 250 ml of acetonitrile and 10 ml of N,N-dimethylformamide. To the admixture was dropwise added 42.4 g of thionyl chloride at room temperature. After the solution underwent a reaction for 30 minutes, it was cooled down to −10° C.

To the solution thus cooled was dropwise added 67.7 g of propylamine while keeping the temperature of the solution at 0° C. or less. After the solution was underwent a reaction at a temperature of 0° C. or less for 30 minutes, ethyl acetate was added thereto. The admixture was washed with water. After the oil phase was separated, the solvent was removed under reduced pressure. The residue was recrystallized from a mixed solvent of ethyl acetate and hexane to obtain 45.2 g of the compound 15.

Step 7

Synthesis of Intermediate Compound 16

45.2 g of the compound 15, which had been prepared in Step 6, was added to a mixed solvent of 300 ml of ethanol and 15 ml of hydrochloric acid. The admixture was heated under reflux for 1 hour. After the reaction solution was allowed to cool down to room temperature, 200 ml of water was added thereto. The crystals thus precipitated was filtered off to obtain 28.6 g of the compound 16.

Step 8

Synthesis of the Illustrative Compound (33)

28.6 g of the compound 16 which had been prepared in Step 7 was added to 600 ml of tetrahydrofuran. After the admixture was cooled down to −10° C., 4.6 g of aluminum chloride was added thereto. To the solution was dropwise added 60 ml of dichloromethane solution containing 8.8 g of 1-phenyltetrazolyl-5-sulfonyl chloride. After the solution underwent a reaction at a temperature of −10° C. for 30 minutes, ethyl acetate and water were added thereto. The reaction solution was transferred to a separating funnel where the oil phase was separated and washed with water. After the oil phase was separated, the solvent was removed under reduced pressure. The residue was recrystallized from a mixed solvent of hexane and ethanol to obtain 24.9 g of the desired illustrative Compound (33). The melting point thereof was 197°-202° C.

Synthesis (3)

Synthesis of Illustrative Compound (22)

The illustrative compound (22) was prepared by the following synthesis:

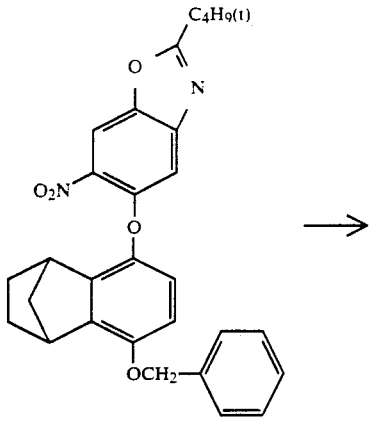

17

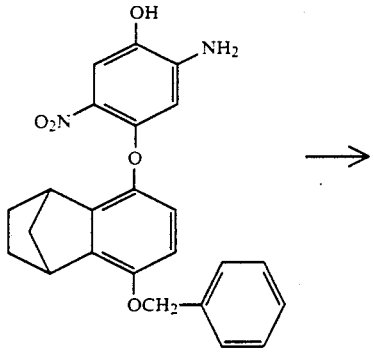

18

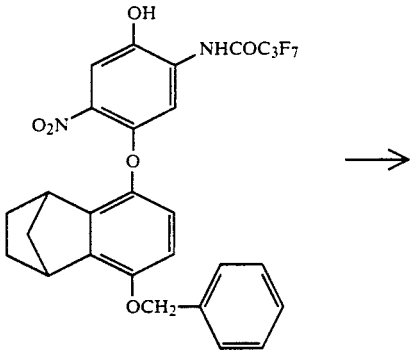

19

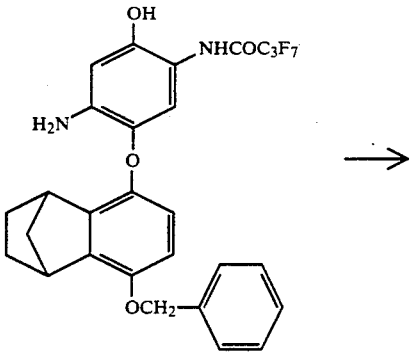

20

-continued

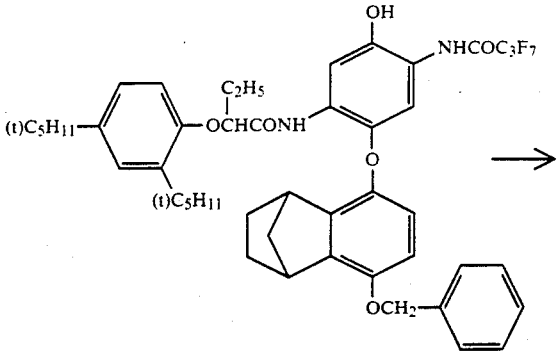

21

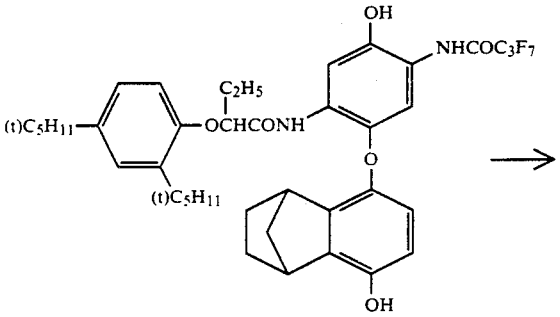

22

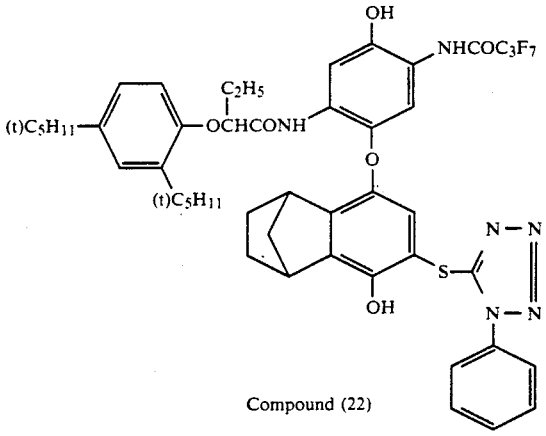

Compound (22)

Step 1

Synthesis of Intermediate Compound 18

34.8 g of the compound 17 was added to a mixed solvent of 300 ml of ethanol and 100 ml of water. The admixture was then purged by bubbling with nitrogen gas. 23.7 g of potassium hydroxide was added to the solution and then heated under reflux for 6 hours. The solution thus refluxed was allowed to cool down to room temperature and mixed with hydrochloric acid until neutralization was reached. 500 ml of ethyl acetate was added to the solution thus neutralized, and the resulting product was transferred to a separating funnel. The product was washed with water. After the oil phase was separated, the solvent was removed under reduced pressure. All the residue (30.1 g) was used in the subsequent step.

Step 2

Synthesis of Intermediate Compound 19

30.1 g of the compound 18 which had been prepared in Step 1 was dissolved in 250 ml of ethyl acetate. 35.4 g of anhydrous heptafluorobutanoic acid was added dropwise to the solution at room temperature. After the solution underwent a reaction at room temperature for 40 minutes, the reaction solution was mixed with an aqueous solution of sodium carbonate until neutralization was reached. The reaction solution was then transferred to a separating funnel where the oil phase was separated and washed with water. After the oil phase was separated, the solvent was removed under reduced pressure. Chloroform was added to the residue so that crystals precipitated. The crystals thus precipitated were filtered off, and the filtrate was then concentrated to obtain 44.1 g of the compound 19 which was all used in the subsequent step.

Step 3

Synthesis of Intermediate Compound 20

44.1 g of the compound 19 which had been prepared in Step 2, 32 g of reduced iron, 3 g of ammonium chloride, and 3 ml of acetic acid were added to a mixed solvent of 150 ml of isopropanol and 50 ml of water. The admixture was heated under reflux for 3 hours. While the solution thus refluxed was hot, it was filtered. The filtrate was concentrated under reduced pressure until crystals precipitated. The filtrate thus concentrated was cooled. The crystals were filtered off to obtain 38 g of the compound 20.

Step 4

Synthesis of Intermediate Compound 21

38 g of the compound 20 was added to 300 ml of acetonitrile. 23.1 g of 2-(2,4-di-t-amylphenoxy)butanoyl chloride was added dropwise to the mixture while it was heated under reflux. After the mixture underwent a reaction under reflux for 3 hours, it was allowed to cool down to room temperature. 500 ml of ethyl acetate was added to the reaction solution. The reaction solution was then washed with water. After the oil phase was separated, the solvent was removed under reduced pressure. The residue was recrystallized from ethyl acetate and acetonitrile to obtain 43.8 g of the compound 21.

Step 5

Synthesis of Intermediate Compound 22

43.8 g of the compound 21 which had been prepared in the previous step was added to 300 ml of dichloromethane. The admixture was cooled to a temperature of 0° C. 24.7 g of boron tribromide was added dropwise to the admixture thus cooled. After the admixture underwent a reaction at a temperature of 0° C. for 2 hours, the reaction solution was gradually heated to a temperature of 5° C. After the reaction solution underwent a reaction at a temperature of 5° C. for 1 hour, a saturated aqueous solution of sodium hydrogencarbonate was added dropwise thereto until neutralization was reached. The solution thus neutralized was transferred to a separating funnel where the oil phase was separated and washed with water. The resulting solution was washed with dilute hydrochloric acid and then with water until neutralization was reached. After the oil phase was separated, the residue was concentrated to obtain 36 g of the compound 22.

Step 6

Synthesis of the Illustrative Compound (22)

8.3 g of 5-mercaptophenyltetrazole and 6.4 g of sulfuryl chloride were reacted with each other in dichloromethane at a temperature of 5° C. for 1 hour. The product was concentrated under reduced pressure. 10 ml of dichloromethane was added to the residue. The admixture was added dropwise at room temperature to a solution which had been prepared by dissolving 36 g of the compound 22 obtained in the previous step in 200 ml of acetonitrile. After the admixture underwent a reaction at room temperature for 2 hours, it was heated to a temperature of 60° C. and underwent a reaction for 1 hour. After the reaction solution was cooled to room temperature, 500 ml of ethyl acetate was added thereto. The solution was transferred to a separating funnel where it was washed with water until neutralization was reached. After the oil phase was separated, the solvent was removed under reduced pressure. The residue was recrystallized from a mixed solvent of ethyl acetate and hexane to obtain 28.5 g of the desired illustrative Compound (22).

Among the compounds (c) used in accordance with the present invention, preferred species are compounds of the following general formula (IV).

$$A\text{-}(B_1)_v\text{-}DI \qquad \text{(IV)}$$

In formula (IV), A has the same meaning as defined in general formula (I); $B_1$ and v each has the same meaning as defined in general formula (B-1); and DI has the same meaning as defined in general formula (D-1).

Referring to general formula (IV), the preferred couplers are those in which v is 0.

The following is a partial listing of the compounds (c) for use in the practice of the present invention. It should be understood that the present invention is by no means limited to the use of these specific compounds.

(101)

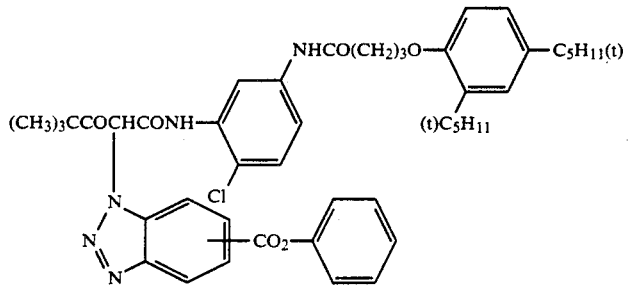

-continued
(102)
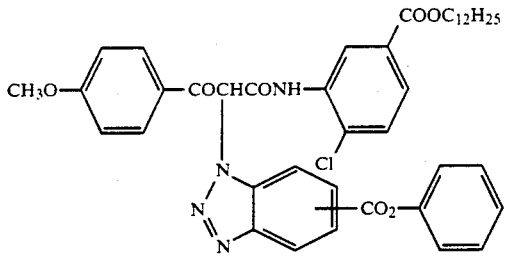
(103)
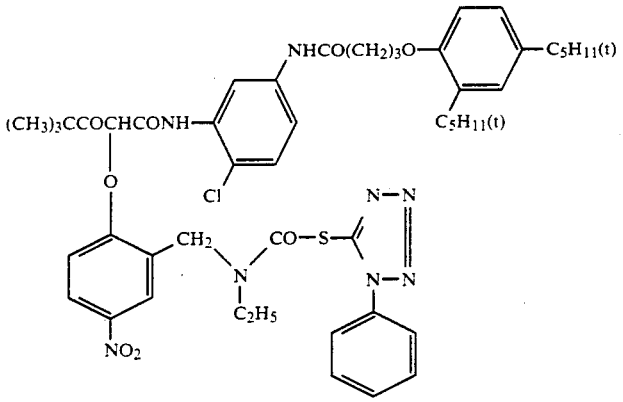
(104)
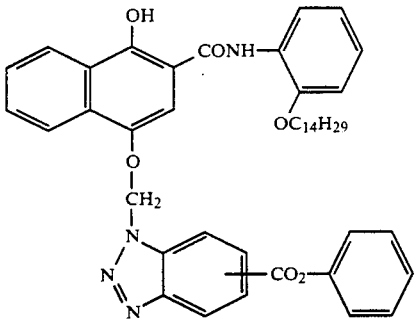
(105)
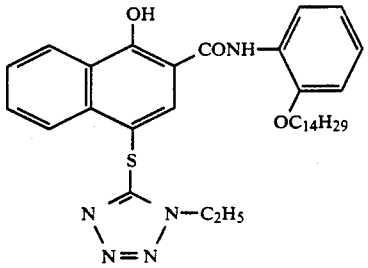

-continued
(106)
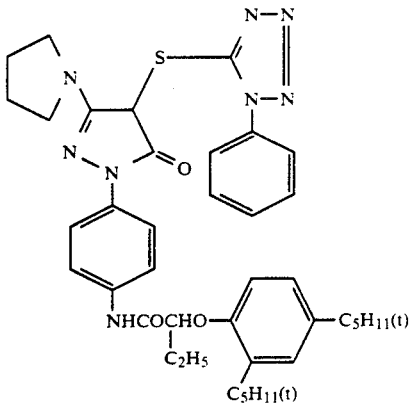
(107)
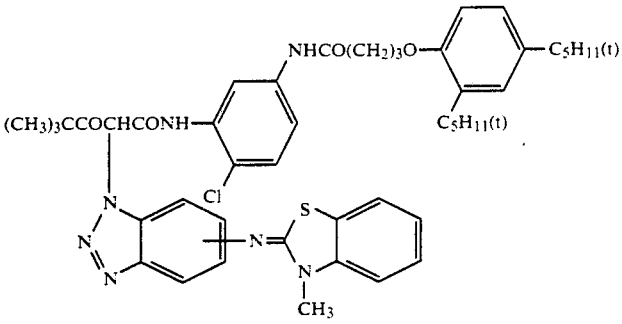
(108)
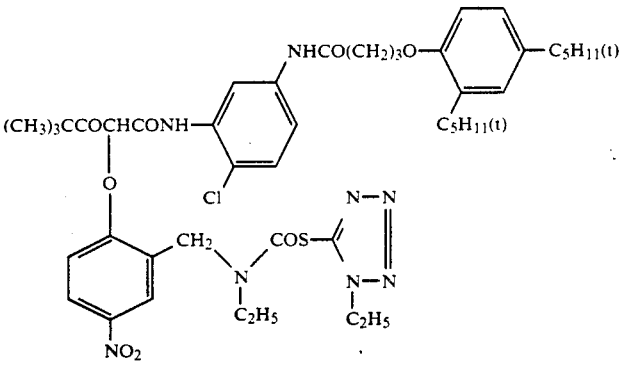
(109)
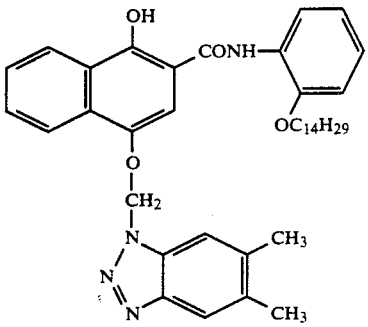

-continued
(110)
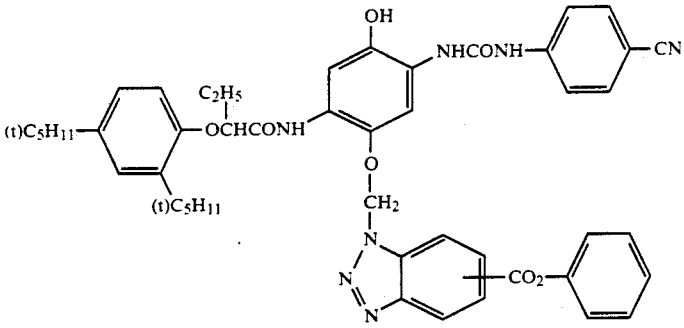
(111)
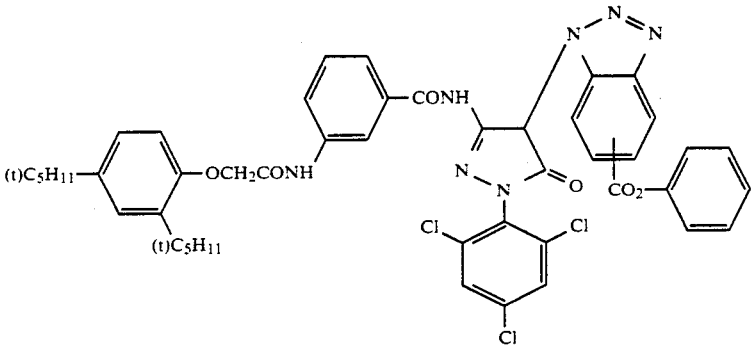
(112)
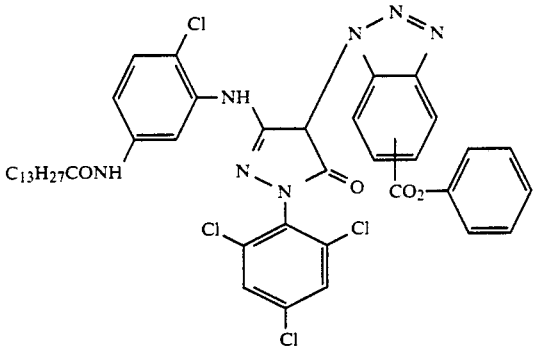
(113)
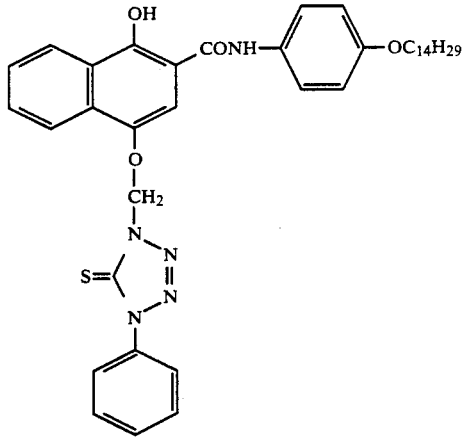

-continued
(114)
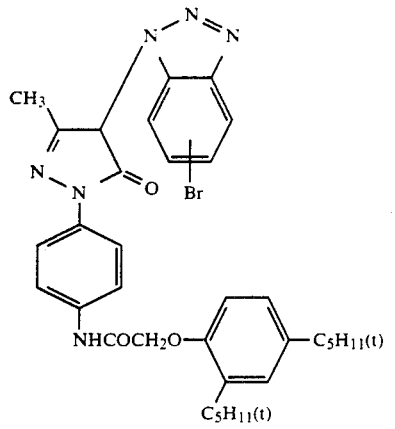
(115)
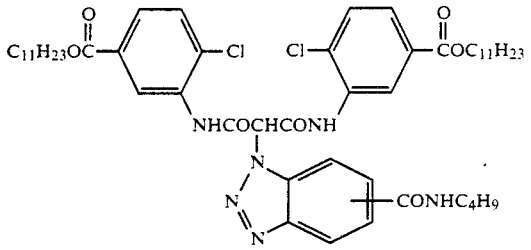
(116)
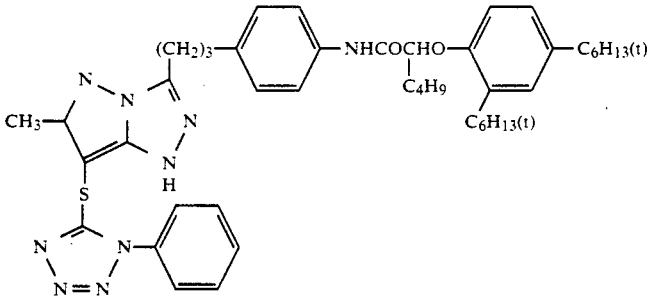
(117)
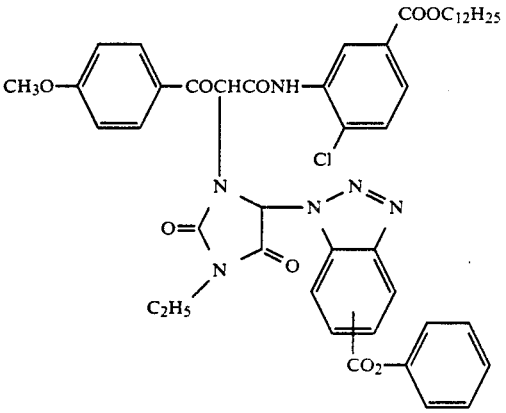

-continued
(118)
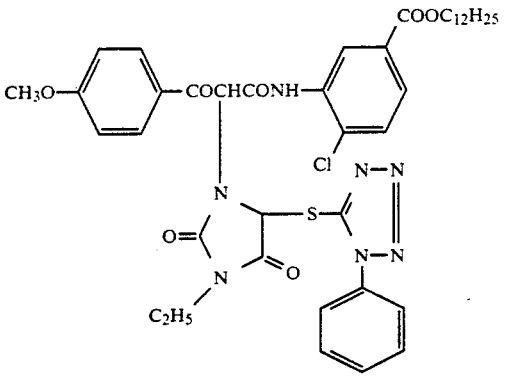
(119)
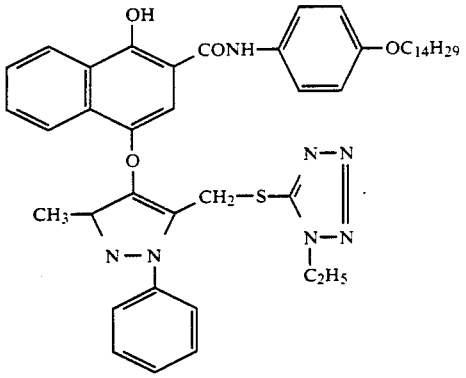
(120)
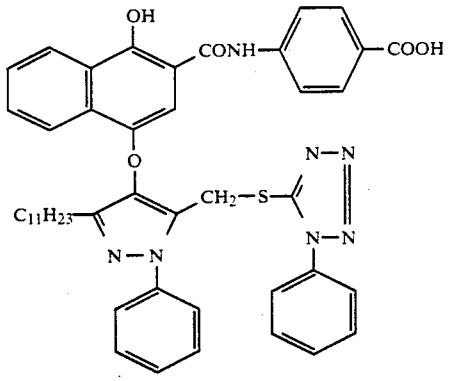
(121)
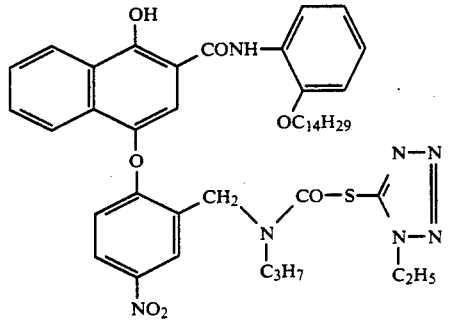

-continued
(122)
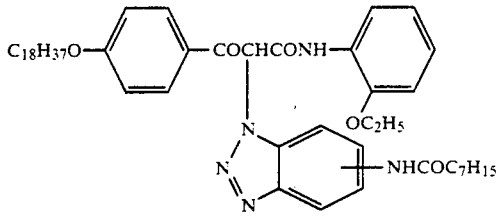
(123)
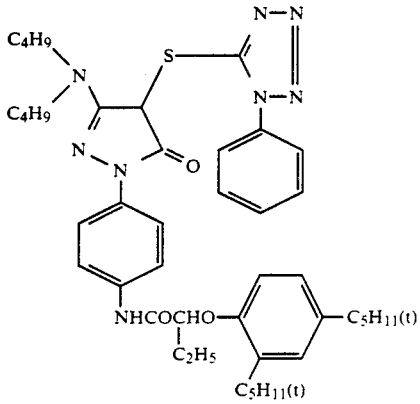
(124)
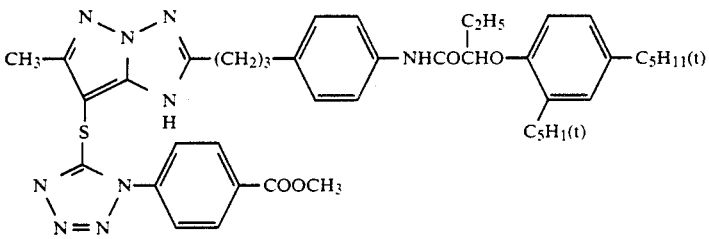
(125)
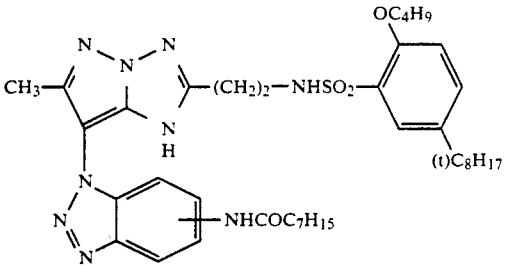
(126)
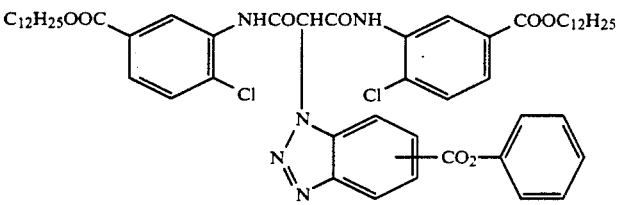
(127)
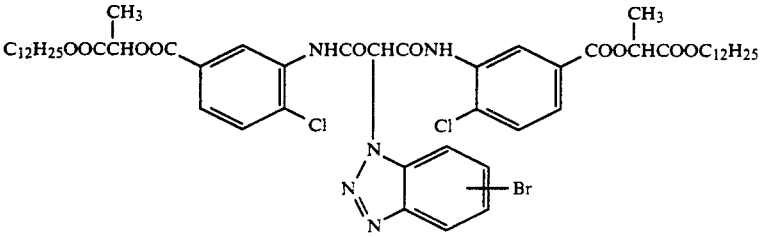

-continued
(128)
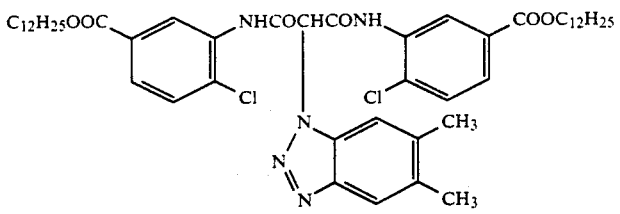
(129)
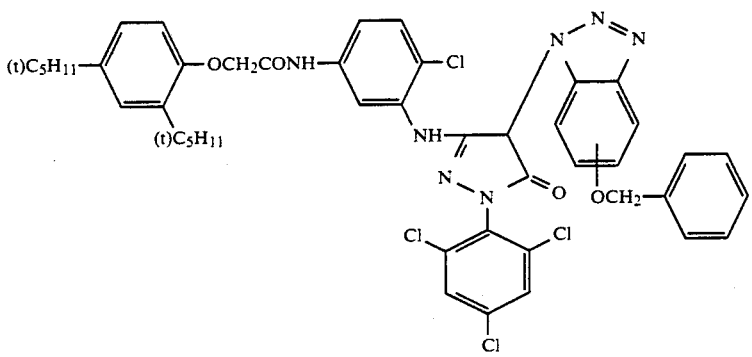
(130)
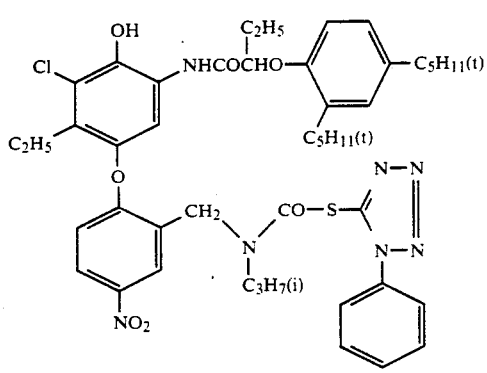
(131)
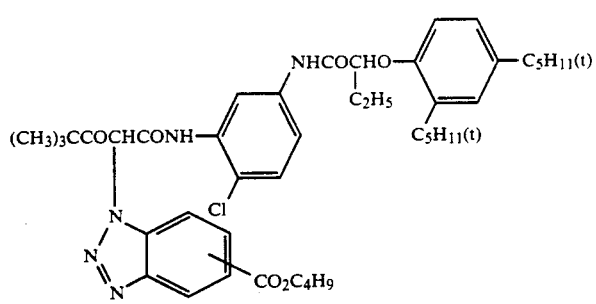
(132)
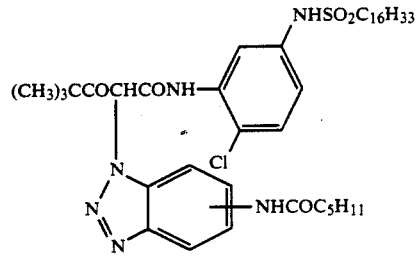

-continued
(133)
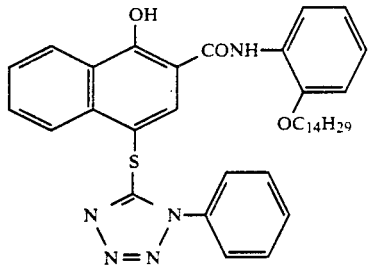
(134)
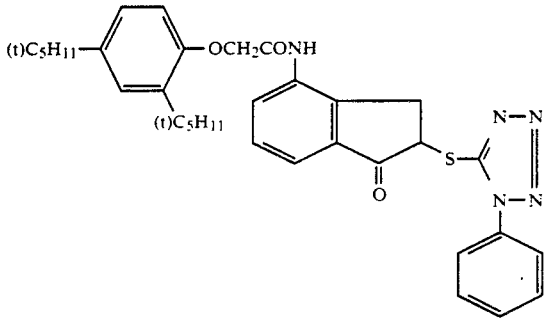
(135)
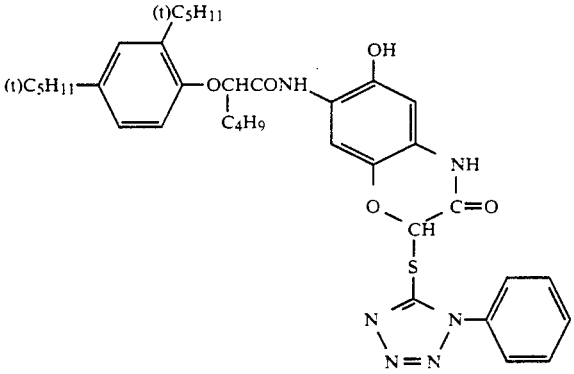
(136)
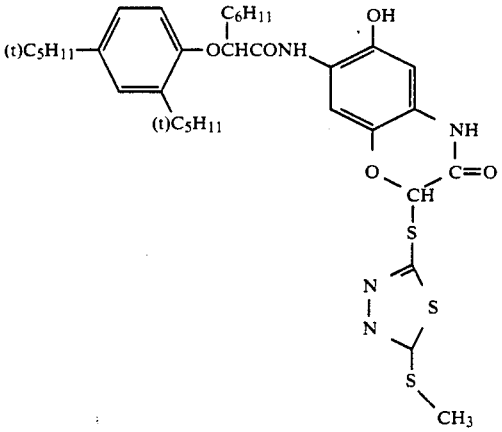

-continued (137)

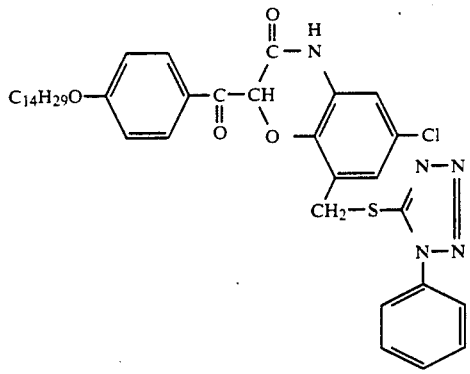

The compounds of general formula (IV) can be easily synthesized by the methods described, for example, in the patents cited in the Background of the Invention section of this specification.

With respect to compound (a) and compound (b), two or more different compounds may respectively be used in the practice of the present invention.

In accordance with the present invention, compounds (a) and/or (b) are preferably incorporated in the silver halide emulsion layer or a layer adjacent thereto in the silver halide color photographic material.

As regards compound (c), two or more species may be employed in the practice of the present invention.

The compound (c) in the present invention is incorporated in the same color sensitive emulsion layer unit or the same non-sensitive layer which contains compound (a) and/or (b). It is sufficient that compounds (a)/(b) and (c) be present in the same color sensitive layer unit, not only in the case where the same color sensitive layer unit is divided into a high sensitive silver halide emulsion layer subunit and a low sensitive silver halide emulsion layer subunit and such subunits are adjacent to each other but also in the case where the light sensitive layers are not adjacent to each other as described in U.S. Pat. Nos. 4,184,876, 4,129,446, 4,186,016 and 4,267,264, European Laid-Open Pat. No. 124,861, Japanese Patent Application (OPI) Nos. 59-180556 and 59-180555, and so on. Furthermore, a non-sensitive layer adjacent to both a high sensitive emulsion layer and a low sensitive emulsion layer in the same color sensitivity series belonging to the same color sensitive emulsion layer unit as mentioned in U.S. Pat. No. 4,438,194, European Laid-Open Patent No. 112,545, Japanese Patent Application (OPI) Nos. 59-1493 and 59-160135 (corresponding to European Patent Publication No. 125,405A), etc., can be used, and compound (a) and/or (b) and compound (c) may be present in any of the above layers for the purposes of the present invention.

Moreover, a non-sensitive layer interposed between two silver halide sensitive layers in different color sensitivity series, even if it is divided into two or more layers, should be regarded as the same non-sensitive layer and it should be appreciated that compounds (a) and (b) of the present invention may be present in such layers.

The useful level of addition of compound (a) or compound (b) according to the present invention to the above defined same color sensitive layer unit or same non-sensitive layer is such that the total sum of the amount added is $10^{-7}$ to $10^{-2}$ mol/m$^2$, preferably $10^{-6}$ to $10^{-3}$ mol/m$^2$, and for still better results, $3\times10^{-6}$ to $5\times10^{-4}$ mol/m$^2$.

The useful level of addition of compound (c) according to the present invention to the above defined same color sensitive layer unit or non-sensitive layer is such that the total sum of the amount added is $10^{-8}$ to $10^{-2}$ mol/m$^2$, preferably $10^{-7}$ to $10^{-3}$ mol/m$^2$, and for still better results, $10^{-6}$ to $3\times10^{-4}$ mol/m$^2$.

There are cases in which satisfactory sharpness, color reproduction and graininess are achieved by a photosensitive material incorporating only the compound described in Japanese Patent Application No. 59-33059 (corresponding to U.S. Pat. No. 4,618,571) referred to hereinbefore, but this is the case only under certain developing conditions and the expected effects are not fully realized on many occasions. However, the present invention enables the art to provide a photosensitive material meeting these requirements in most cases. The cause for this improved result remains to be elucidated as yet but the following presumptions are tentatively advanced.

As set forth in Japanese Patent Application No. 59-33059 (corresponding to U.S. Pat. No. 4,618,571, in order that a compound may display a development inhibiting action, the RED-PUG moiety (PUG is the development inhibitor in the present invention) released upon the coupling reaction with an oxidized developing agent must be converted to OX-PUG (OX means the oxidized form of RED) by another molecule of oxidized developing agent, whereby the release of PUG is made possible. PUG is then released by the nucleophilic attack of an OH ion, a sulfite ion, hydroxylamine, etc., contained in the developer solution. As a consequence, the degree of dependence on the developing activity of the developer solution (developer concentration, pAg, sulfite ion concentration, pH, etc.) which is determinant of the rate (developing rate) of production of oxidized developing agent becomes greater than ever. Even if one attempts to optimize conditions at the research laboratory level, development under stable conditions may not be available in a commercial development laboratory where running processes under varied conditions take place with resultant variations in the fatigue level of developer solutions. It appears that the beneficial effects of the present invention arise from the fact that the degree of development is controlled by the presence of the compounds per the present invention which are adapted to release a development inhibitor or a percursor thereof in the manner described hereinbefore.

Further, by using suitable species of the compounds of the present invention, it becomes easier to optimize sharpness, graininess and color reproduction (interlayer effect), functions which DIR compounds in general are expected to exhibit.

The color photographic material according to the present invention includes, as disposed on a film base or support, at least one layer each of red-sensitive, green-sensitive and blue-sensitive emulsion layer units. The sequence of these layers is optional. It is common practice to incorporate a cyan color forming coupler in the red-sensitive emulsion layer, a magenta color forming coupler in the green-sensitive emulsion layer and a yellow color forming coupler in the blue-sensitive emulsion layer, but other combinations may also be employed according to the situation.

In the same or different photographic emulsion layer or non-sensitive layers of the color photographic photosensitive material according to the present invention, there may be incorporated, together with compounds of general formulae (I) and (IV) mentioned hereinbefore, so-called color couplers adapted to develop colors on oxidative coupling with an aromatic primary amine developing agent (for example, phenylenediamine derivatives, aminophenol derivatives, etc.) in color development.

In the silver halide multilayer color photographic material, ywllow, magenta and cyan forming couplers are generally employed. For the purposes of the present invention, useful color couplers include conventional cyan, magenta and yellow couplers and, as typical species of such couplers, there may be mentioned naphthol or phenol compounds, pyrazolone or pyrazoloazole compounds, and open chain or heterocyclic ketomethylene compounds. Specific examples of such cyan, magenta and yellow couplers that can be employed in the practice of the present invention are given in the patent literature referred to in *Research Disclosure*, 17643 (December, 1978), VII-D and 18717 (November, 1979).

The color couplers incorporated in the photosensitive material are preferably rendered nondiffusible either by means of a ballast group(s) or by way of polymerization. A higher sensitivity and reduced silver coverage can be obtained with a 2-equivalent color coupler substituted with a cleavable group than with a 4-equivalent color coupler having a hydrogen atom in the coupling position. Couplers providing dyes possessing controlled diffusibility or couplers adapted to release development accelerators may also be utilized.

Tye yellow coupler which is suitable for the present invention is typically exemplified by acylacetamide couplers of the "oil protected" type. Specific examples of such couplers are mentioned in U.S. Pat. Nos. 2,407,210, 2,875,057 and 3,265,506, among others. The 2-equivalent yellow coupler includes, among others, the yellow couplers of the oxygen atom cleavage type as set forth in U.S. Pat. Nos. 3,408,194, 3,447,928, 3,993,501 and 4,022,620, and the yellow couplers of the nitrogen atom cleavage type such as those described in Japanese Patent Publication No. 58-10739, U.S. Pat. Nos. 4,401,752 and 4,326,024, RE 18053 (April, 1979), British Patent 1,425,020, German Patent Specification Offenlegungsschrift Nos. 2,219,917, 2,261,361, 2,329,587 and 2,433,812 and so on. The α-pivaloylacetanilide type couplers are satisfactory in fastness, particularly light fastness, of the color produced, while α-benzoylacetanilide type couplers yield high color densities.

The magenta couplers which are compatible with the present invention may, for example, be "oil protected" type indazolone or cyanoacetyl couplers, preferably 5-pyrazolone and pyrazoloazole (e.g., pyrazolotriazole) couplers. Among the 5-pyrazolone type couplers, a coupler having an arylamino or acylamino group as a 3-substituent is preferred in terms of the hue and density of the color developed. Typical examples of such compound are described in U.S. Pat. Nos. 2,311,082, 2,343,703, 2,600,788, 2,908,573, 3,062,653, 3,152,896 and 3,936,015, among others. The cleavage group of a 2-equivalent 5-pyrazolone type coupler is preferably a nitrogen atom cleavage group as set forth in U.S. Pat. No. 4,310,619 or an arylthio group as described in U.S. Pat. No. 4,351,897. With the 5-pyrazolone type couplers having ballast groups as described in European Patent No. 73,636, there can be obtained high color density.

As examples of such pyrazoloazole type couplers, there may be mentioned the pyrazolobenzimidazole compounds described in U.S. Pat. No. 3,369,879 and preferably the pyrazolo[5,1-c][1,2,4]triazoles described in U.S. Pat. No. 3,725,067, the pyrazolotetrazoles mentioned in *Research Disclosure*, 24220 (June, 1984), and the pyrazolopyrazoles mentioned in *Research Disclosure*, 24230 (June, 1984). In view of the low yellow side absorption of the developed dye and light fastness, the imidazo[1,2-b]pyrazoles taught by European Patent No. 119,741 are preferred and the pyrazolo[1,5-b][1,2,4]triazoles described in European Patent No. 119,860 are particularly desirable.

The cyan couplers which are compatible with the present invention include "oil protected" type naphthol and phenol couplers and, as specific examples of such cyan couplers, there may be mentioned the naphthol type couplers described in U.S. Pat. No. 2,474,293 and, preferably, the 2-equivalent naphthol couplers of the oxygen atom cleavage type such as those described in U.S. Pat. Nos. 4,052,212, 4,146,396, 4,228,233 and 4,296,200. Typical examples of such phenol type couplers are mentioned in U.S. Pat. Nos. 2,369,929, 2,801,171, 2,772,162 and 2,895,826, among others.

Humidity and temperature resistant cyan couplers can be used with advantage in accordance with the present invention. As typical examples of such cyan couplers, reference may be made to the phenol type couplers having an ethyl or higher alkyl group at the meta-position of the phenol nucleus such as those described in U.S. Pat. No. 3,772,002, the 2,5-diacylamino-substituted phenol couplers described in U.S. Pat. Nos. 2,772,162, 3,758,308, 4,126,396, 4,334,011 and 4,327,173, German Patent Specification Offenlegungsschrift No. 3,329,729 and Japanese Patent Application No. 58-42671, among others, and phenol type couplers having a phenylureido group at the 2-position and an acylamino group at the 5-position such as those described in U.S. Pat. Nos. 3,446,622, 4,333,999, 4,451,559 and 4,427,767, among others.

In order to correct unwanted absorptions in the shortwave region by dyes derived from magenta and cyan couplers, it is desirable to use colored couplers in color photosensitive materials for picture taking use. Typical examples of such colored couplers are the yellow colored magenta couplers described in U.S. Pat. No. 4,163,670 and Japanese Patent Publication No. 57-39413 and the magenta colored cyan couplers described in U.S. Pat. Nos. 4,004,929 and 4,138,258 and British Patent 1,146,368.

Improved granularity may be achieved by the simultaneous use of couplers ensuring a suitable diffusibility of the developed dye. Typical examples of such magenta couplers are mentioned in U.S. Pat. No. 4,366,237 and British Patent 2,125,570, while European Patent No. 96,570 and German Patent Specification Offenlegungsschrift No. 3,234,533 teach examples of such yellow, magenta and cyan couplers.

The color forming couplers and such special couplers may each be a dimer, oligomer or polymer. Examples of such polymeric dye forming couplers are mentioned in U.S. Pat. Nos. 3,451,820 and 4,080,211. British Patent 2,102,173 and U.S. Pat. No. 4,367,282 give examples of polymerized magenta couplers.

These couplers may be 4-equivalent or 2-equivalent with respect to silver ion.

In addition to the DIR couplers used in accordance with the present invention, colorless DIR coupling compounds which give colorless coupling reactive products and release a development inhibitor may also be incorporated in the photosensitive material.

In order to meet the characteristic requirements of each photosensitive material, the above mentioned various couplers may be incorporated as a combination of two or more kinds in the same photographic layer or the same compound may be incorporated in two or more different layers.

Incorporation of the compounds according to the present invention and the aforementioned compatible couplers in the silver halide emulsion layers can be effected by per se known procedures, such as the method described in U.S. Pat. No. 2,322,027. By way of illustration, the compound to be incorporated is first dissolved in a solvent such as an alkyl ester of phthalic acid (e.g., dibutyl phthalate, dioctyl phthalate, etc.), a phosphoric acid ester (e.g., diphenyl phosphate, triphenyl phosphate, tricresyl phosphate, dioctyl butyl phosphate), a citric acid ester (e.g., tributyl acetylcitrate), a benzoic acid ester (e.g., octyl benzoate), an alkylamide (e.g., diethyllaurylamide), a fatty acid ester (e.g.. dibutoxyethyl succinate, diethyl azelate), a trimesic acid ester (e.g., tributyl trimesinate), etc., an organic solvent having a boiling point in the range of about 30° C. to 150° C., e.g., a lower alkyl acetate such as ethyl acetate, butyl acetate, etc., ethyl propionate, sec-butyl alcohol, methyl isobutyl ketone, $\beta$-ethoxyethyl acetate, methyl cellosolve acetate, and so on. The solution is then uniformly dispersed in a hydrophilic colloid. The above high boiling and low boiling organic solvents may also be used as a mixture.

It is also possible to employ the dispersing method involving the use of a polymer as described in Japanese Patent Publication No. 51-39853 and Japanese Patent Application (OPI) No. 51-59943.

When the coupler has an acid group such as a carboxy or sulfonyl group, it is added in the form of an alkaline aqueous solution to the hydrophilic colloid.

As the binding agent or protective colloid that can be used in the emulsion layers and intermediate layers, gelatin is advantageous but other conventional hydrophilic colloids can be used alone or in combination with gelatin.

The gelatin used in the practice of the present invention may be lime treated gelatin or acid treated gelatin. A detailed discussion on methods for preparation of gelatin can be found in Arthur Weiss, *The Macromolecular Chemistry of Gelatin*, Academic Press, 1964.

As to the silver halide for use in the preparation of the photographic emulsion layers of the color photographic materials according to the present invention, there can be used any of silver bromide, silver bromoiodide, silver bromoiodochloride, silver bromochloride and silver chloride. The preferred silver halide is silver bromoiodide including a maximum of 15 mol % of silver iodide. Particularly desirable is silver bromoiodide including 2 to 15 mol % of silver iodide.

There is no particular limitation on the average grain size of the silver halide in the photographic emulsion but the average grain size is preferably not greater than 3 $\mu$m. The average grain size is such that in the case of spherical or pseudo-spherical grains, the diameter of the grain is taken as the grain size or, in the case of cubic grains, the length of the edge of the cube is regarded as the grain size and the average grain size is calculated from the projected area.

The grain size distribution may be narrow or broad.

The geometry of the silver halide grains in the photographic emulsions may be cubic, octahedral or any other regular crystal shape or the silver halide grains can have irregular crystal shapes such as spheres, platelets, etc., or amy be a composite of such shapes. The grains may thus be present as a mixture of grains having various crystal shapes.

It is also possible to use an emulsion in which ultraflat silver halide grains whose diameters are more than 5 times their thicknesses account for more than 50% of the total projected area.

The silver halide grain may also be heterophasic as to the core portion and the surface layer thereof and may be grains where a latent image is predominantly formed in the surface layer or in the core portion.

The photographic emulsions employed in accordance with the present invention can be prepared by the methods described, for example, in P. Glafkides, *Chimie et Physique Photographique* (Paul Montel, 1966), and V. L. Zelikman et al, *Making and Coating Photographic Emulsion* (The Focal Press, 1964). Thus, any of the acid method, neutral method, ammonia method, etc., can be utilized and as methods comprising reacting a soluble silver salt with a soluble halogen salt, any of single jet, double jet, or a combination thereof may be employed.

The method in which grains are formed in the presence of an excess of silver ion (reversed mixing method) may also be employed. As a mode of simultaneous mixing, one may employ the controlled double jet method, where the pAg in the liquid phase where silver halide is formed is kept constant.

This particular method yields a silver halide emulsion which is regular in crystal shape and nearly uniform in grain size.

It is also possible to admix two or more independently prepared silver halide emulsions.

In the course of the formation or physical ripening of silver halide grains, compounds such as cadmium salts, zinc salts, thallium salts, iridium salts and complex salts thereof, rhodium salts and complex salts thereof, iron salts and complex salts thereof, etc., may be present.

The silver halide emulsions are usually chemically sensitized. For chemical sensitization, the methods described in H. Frieser ed., *Die Grundlagen der Photographischen Prozesse mit Silver Halogeniden*, Akademische Verlagsgesellschaft, 1968, pp. 675–734, for instance, can be employed.

Thus, sulfur sensitization using a sulfur containing compound capable of reacting with activated gelatin and silver (for example, thiosulfates, thiourea compounds, mercapto compounds, rhodanines), reduction sensitization utilizing reducing agents (such as stannous salts, amines, hydrazine derivatives, formamidinesulfinic acid, silane compounds, etc.), noble metal sensitization using a noble metal (for example, complex salts of gold, complex salts of metals of elements of Group VIII of the Periodic Table of the Elements, such as Pt, Ir, Pd, etc.), and other sensitization methods may be used singly or in combination.

For the purpose of preventing fogging during manufacture and storage of photosensitive materials or during photographic processing or/and for stabilizing photographic performance qualities, a variety of compounds may be incorporated. Thus, there may be incorporated many compounds known as antifoggants or stabilizers, for example, various azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole), etc.; mercaptopyrimidines; mercaptotriazines, thioketo compounds such as oxazolinethiol; azaindenes such as triazaindenes, tetraazaindenes (particularly, 4-hydroxysubstituted(1,3,3a,7)tetraazaindenes), pentaazaindenes, etc.; benzenethiosulfonic acid, benzenesulfinic acid, benzenesulfonamide, and so on.

The photographic emulsion layers or other hydrophilic colloid layers in the photographic material according to the present invention may contain various surfactants added for varied purposes, e.g., as coating auxiliaries or antistatic agents, for lubrication, emulsification and dispersion, for prevention of adhesion, improvement of photographic characteristics (for example, development acceleration, tone hardening, sensitization, etc.) and so on.

For increased sensitivity, increased contrast or development acceleration, the silver halide emulsions in the color photographic material according to the present invention may contain, among others, polyalkylene oxides and their ethers, esters, amines and other derivatives, thioether compounds, thiomorpholine compounds, quaternary ammonium salts, urethane derivatives, urea derivatives, imidazole derivatives, 3-pyrazolidones and so on.

For improved dimensional stability and other purposes, the color photographic material according to the present invention may contain dispersions of synthetic polymers either insoluble or only sparingly soluble in water in photographic emulsion layers or other hydrophilic colloid layers thereof. Such polymers may be homopolymers or copolymers of monomers such as alkyl acrylates, alkyl methacrylates, alkoxyalkyl acrylates, alkoxyalkyl methacrylates, glycidyl acrylate, glycidyl methacrylate, acrylamide, methacrylamide, vinyl esters (e.g., vinyl acetate), acrylonitrile, olefins, styrene, and so on or copolymers of said various monomers with other comonomers such as acrylic acid, methacrylic acid, $\alpha,\beta$-unsaturated dicarboxylic acids, hydroxyalkyl acrylates, hydroxyalkyl methacrylates, sulfoalkyl acrylates, sulfoalkyl methacrylates, styrenesulfonic acid and so on.

The photographic emulsions used in the present invention may be spectrally sensitized with methine dyes and the like. The dyes used for this purpose include cyanine dyes, merocyanine dyes, composite cyanine dyes, composite merocyanine dyes, holopolar cyanine dyes, hemicyanine dyes, styryl dyes and hemioxonol dyes. Particularly useful dyes are cyanine dyes, merocyanine dyes and composite merocyanine dyes. For these dyes, any of the basic heterocyclic nuclei commonly used in cyanine dyes can be employed. Thus, there may be mentioned pyrroline, oxazoline, thiazoline, pyrrole, oxazole, thiazole, selenazole, imidazole, tetrazole, pyridine and other heterocyclic nuclei; nuclei formed by fusion of alicycles to said heterocyclic nuclei; and nuclei formed by fusion of aromatic rings to such nuclei; for example, indolenine, benzindolenine, indole, benzoxazole, naphthoxazole, benzothiazole, naphthothiazole, benzoselenazole, benzimidazole, quinoline and other ring structures. These nuclei may have substituents on the carbon atoms thereof.

With regard to merocyanine dyes or composite merocyanine dyes, as nuclei having ketomethylene structures there may be employed 5- or 6-membered heterocyclic nuclei such as pyrazolin-5-one, thiohydantoin, 2-thiooxazolidine-2,4-dione, thiazolidine-2,4-dione, rhodanine, thiobarbituric acid and so on.

These sensitizing dyes may be used either alone or in combination and a combination of sensitizing dyes is frequently used for supersensitizing purposes.

Along with sensitizing dyes, supersensitizing substances which, as they are, have no spectral sensitizing activity or do not substantially absorb visible light may be incorporated in the emulsion. For example, aminostyryl compounds substituted by nitrogen containing heterocyclic groups (for example, the compounds described in U.S. Pat. Nos. 2,933,390 and 3,635,721), aromatic organic acid-formaldehyde condensates (for example, the compounds described in U.S. Pat. No. 3,743,510), cadmium salts, azaindene compounds and so forth may be incorporated.

The photographic materials according to the present invention may contain an organic or inorganic hardener in the photographic emulsion layers and other hydrophilic colloid layers. For example, chromium salts (chrome alum, chromium acetate, etc.), aldehydes (formaldehyde, glyoxal, glutaraldehyde, etc.), N-methylol compounds (dimethylolurea, methyloldimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.) and so on may be used alone or in combination.

In the photosensitive material according to the present invention, when dyes, ultraviolet absorbers and the like are included in the hydrophilic colloid layers, they may be mordanted by cationic polymers.

The photosensitive material according to the present invention may contain color antifoggants such as hydroquinone derivatives, aminophenol derivatives, pyrogallic acid derivatives, ascorbic acid derivatives and so on.

In the photosensitive material prepared in accordance with the present invention, there may be incorporated ultraviolet absorbants in the hydrophilic colloid layers thereof. For example, there may be utilized aryl substituted benzotriazole compounds (for example, the compounds described in U.S. Pat. No. 3,533,794), 4-thiazolidone compounds (for example, the compounds described in U.S. Pat. Nos. 3,314,794 and 3,352,681), benzophenone compounds (for example, those described in Japanese Patent Application (OPI) No. 46-2784), cinnamic acid ester compounds (for example, the compounds described in U.S. Pat. Nos. 3,705,805 and 3,707,375), butadiene compounds (for example, the compounds described in U.S. Pat. No. 4,045,229) and benzoxazole compounds (for example, the compounds described in U.S. Pat. No. 3,700,455). The ultraviolet absorbing couplers (for example, cyan forming couplers in the α-naphthol series) and ultraviolet absorbing polymers may be used. These ultraviolet absorbants may be mordanted in specific layers.

The photosensitive material according to the present invention may contain, in the hydrophilic colloid layers thereof, certain water-soluble dyes as filter dyes or for prevention of irradiation and other purposes, water-soluble dyes. Among such dyes are oxonol dyes, hemioxonol dyes, styryl dyes, merocyanine dyes, cyanine dyes and azo dyes. Particularly useful are oxonol dyes, hemioxonol dyes and merocyanine dyes.

In working the present invention, the hereafter mentioned known fading inhibitors can be employed with the color image stabilizers used in the practice of the present invention, alone or in combination. The known fading inhibitors include hydroquinone derivatives, pyrogallic acid derivatives, p-alkoxyphenols, p-oxyphenol derivatives, bisphenols, and so on.

For photographic processing of the layers comprising the photographic emulsions according to the present invention, any of the known methods and known processing compositions described in *Research Disclosure*, 176, pp. 28–30, for instance, can be utilized. The processing temperature is generally selected from the range of 18° C. to 50° C., although a temperature either below 18° C. or over 50° C. may be employed.

The color developer is generally an alkaline aqueous solution containing the color developing agent. As the color developing agent, one may employ the conventional primary aromatic amine developers such as phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, and so on.

Aside from the above compounds, the compounds mentioned in F. A. Mason, *Photographic Processing Chemistry* (The Focal Press, 1966), pp. 226–229, U.S. Pat. Nos. 2,193,015 and 2,592,364 and Japanese Patent Application (OPI) No. 48-64933, for instance, may also be employed.

The color developer may include pH buffers such as alkali metal sulfites, carbonates, borates, and phosphates, and development inhibitors or antifoggants such as bromides, iodides and organic antifoggants. If desired or necessary, various water softening agents, fungicides such as hydroxylamine, etc., organic solvents such as benzyl alcohol, diethylene glycol, etc., development accelerators such as polyethylene glycol, quaternary ammonium salts, amines, etc., dye forming couplers, competing couplers, fogging agents such as sodium borohydride, development auxiliaries such as 1-phenyl-3-pyrazolidone, etc., tackifiers, polycarboxylic acid type chelating agents, oxidation inhibitors and so on may also be added.

The photographic emulsion layers following color development are generally bleached. This bleaching treatment can be conducted simultaneously with fixing or independently of fixing. The bleaching agents include polyvalent metal compounds such as iron (III), cobalt (III), chromium (VI) and copper (II) compounds, peracids, quinones, nitroso compounds and so on.

For example, ferricyanides, dichromates, organic iron(III) or cobalt(III) complex salts, aminopolycarboxylic acids such as ethylenediaminetetraacetic acid, nitrilotriacetic acid, 1,3-diamino-2-propanoltetraacetic acid, etc., complex salts of organic acids such as citric acid, tartaric acid, malic acid, etc., persulfates, permanganates, nitrosophenol and so on may be employed. Among these compounds, potassium ferricyanide, sodium Fe(III) ethylenediaminetetraacetate, and ammonium Fe(III) ethylenediaminetetraacetate are particularly useful. The Fe(III)EDTA complex salt is useful not only in an independent bleach solution but also in a bleach-fix system.

As the fixing solution, conventional compositions can be employed. The fixing agent may be, e.g., either a thiosulfate or thiocyanate ion. Also, an organic sulfur compound known to be an effective fixing agent may be employed. The fixing solution may contain a water-soluble aluminum salt as a hardener.

While the fixing process or the bleach-fix process is generally followed by aqueous washing, stabilization and other treatments, an expedient procedure involving a washing step only or, conversely, one involving a stabilization step without any substantial washing (see Japanese Patent Application (OPI) No. 57-8543) may also be employed.

In the water used in the washing process, there may be incorporated conventional additives, if desired or necessary. For example, chelating compounds such as inorganic phosphates, aminopolycarboxylic acids, organic phosphates, etc., bactericides and fungicides for inhibiting the growth of various bacteria and algae, hardeners such as magnesium salts, aluminum salts, etc., and surfactants adapted to prevent drying load and unevenness may be employed. The compounds mentioned in L. E. West, *Water Quality Criteria*, Photographic Science and Engineering, Vol. 9, No. 6, pp. 344–359 (1965), for instance, may likewise be employed.

The washing may be carried out using two or more baths as desired or necessary or, to effect savings in water, a multistage (e.g., 2 to 9 stages) counter-current washing system may be employed.

As the stabilizing solution for use in the stabilization process, a solution adapted to stabilize the color image is employed. For example, a buffering solution with a pH of 3 to 6 or an aldehyde (e.g., formaldehyde) containing solution may be utilized. In the stabilizing solution, there may be incorporated a fluorescent whitener, chelating agent, bactericide, fungicide, hardener, surfactant and so on, if desired or necessary.

The stabilization procedure may be carried out using two or more baths or, to effect savings in the stabilizing solution and omit an independent washing step, a multistage (e.g., 2 to 9 stages) countercurrent stabilization system may be utilized.

The processing methods, in which the amount of the washing composition and/or stabilizing composition replenished is reduced, are described, for example, in U.S. Pat. No. 4,336,324 and 4,567,134.

The following examples are intended to illustrate the present invention in further detail and should by no means be construed as limiting the scope of the invention.

EXAMPLE 1

On a transparent cellulose triacetate film support there was formed a multilayer color photosensitive material consisting of layers of the following compositions to provide Sample 101. The coating amount of any emulsion is expressed as silver coverage.

| Sample 101 | |
|---|---|
| First Layer: An Antihalation Layer | |
| A gelatin layer containing: | |
| Black colloidal silver | 0.15 g/m$^2$ |
| Ultraviolet Absorber U-1 | 0.08 g/m$^2$ |
| Ultraviolet Absorber U-2 | 0.12 g/m$^2$ |
| Second Layer: An Intermediate Layer | |
| A gelatin layer containing: | |
| 2,5-Di-t-pentadecylhydroquinone | 0.18 g/m$^2$ |
| Coupler C-1 | 0.11 g/m$^2$ |
| Third Layer: A First Red Sensitive Emulsion Layer | |
| A gelatin layer containing: | |
| Silver bromoiodide (silver iodide 4 mol %, average grain size: 0.4 μm) | 1.2 g/m$^2$ |
| Sensitizing Dye I | 1.4 × 10$^{-4}$ mol/mol Ag |
| Sensitizing Dye II | 0.4 × 10$^{-4}$ mol/mol Ag |
| Sensitizing Dye III | 5.6 × 10$^{-4}$ mol/mol Ag |
| Sensitizing Dye IV | 4.0 × 10$^{-4}$ mol/mol Ag |
| Coupler C-2 | 0.45 g/m$^2$ |
| Coupler C-3 | 0.035 g/m$^2$ |
| Compound (101) | 0.050 g/m$^2$ |
| Fourth Layer: A Second Red Sensitive Emulsion Layer | |
| A gelatin layer containing: | |
| Silver bromoiodide (silver iodide 9 mol %, average grain size: 0.8 μm) | 1.0 g/m$^2$ |
| Sensitizing Dye I | 5.2 × 10$^{-5}$ mol/mol Ag |
| Sensitizing Dye II | 1.5 × 10$^{-5}$ mol/mol Ag |
| Sensitizing Dye III | 2.1 × 10$^{-4}$ mol/mol Ag |
| Sensitizing Dye IV | 1.5 × 10$^{-5}$ mol/mol Ag |
| Coupler C-4 | 0.050 g/m$^2$ |
| Coupler C-5 | 0.070 g/m$^2$ |
| Coupler C-3 | 0.035 g/m$^2$ |
| Fifth Layer: An Intermediate Layer | |
| A gelatin layer containing: | |
| 2,5-Di-t-pentadecylhydroquinone | 0.08 g/m$^2$ |
| Sixth Layer: A First Green Sensitive Emulsion Layer | |
| A gelatin layer containing: | |
| Silver bromoiodide (silver iodide 5 mol %, average, grain size: 0.4 μm) | 0.80 g/m$^2$ |
| Sensitizing Dye V | 4.0 × 10$^{-4}$ mol/mol Ag |
| Sensitizing Dye VI | 3.0 × 10$^{-5}$ mol/mol Ag |
| Sensitizing Dye VII | 1.0 × 10$^{-4}$ mol/mol Ag |
| Coupler C-6 | 0.45 g/m$^2$ |
| Coupler C-7 | 0.13 g/m$^2$ |
| Coupler C-8 | 0.02 g/m$^2$ |
| Compound (101) | 0.04 g/m$^2$ |
| Seventh Layer: A Second Green Sensitive Emulsion Layer | |
| A gelatin layer containing: | |
| Silver bromoiodide (silver | 0.85 g/m$^2$ |

-continued

| Sample 101 | |
|---|---|
| iodide 8 mol %, average grain size 0.9 μm) | |
| Sensitizing Dye V | 2.7 × 10$^{-4}$ mol/mol Ag |
| Sensitizing Dye VI | 1.8 × 10$^{-5}$ mol/mol Ag |
| Sensitizing Dye VII | 7.5 × 10$^{-5}$ mol/mol Ag |
| Coupler C-6 | 0.095 g/m$^2$ |
| Coupler C-7 | 0.015 g/m$^2$ |
| Eighth Layer: A Yellow Filter Layer | |
| A gelatin layer containing: | |
| Yellow colloidal silver | 0.08 g/m$^2$ |
| 2,5-Di-t-pentadecylhydroquinone | 0.090 g/m$^2$ |
| Ninth Layer: A First Blue Sensitive Emulsion Layer | |
| A gelatin layer containing: | |
| Silver bromoiodide (silver iodide 5 mol %, average grain size: 0.3 μm) | 0.37 g/m$^2$ |
| Sensitizing Dye VIII | 4.4 × 10$^{-4}$ mol/mol Ag |
| Coupler C-9 | 0.71 g/m$^2$ |
| Compound (101) | 0.070 g/m$^2$ |
| Tenth Layer: A Second Blue Sensitive Emulsion Layer | |
| A gelatin layer containing: | |
| Silver bromoiodide (silver iodide 9 mol %, average grain size: 0.9 μm) | 0.55 g/m$^2$ |
| Sensitizing Dye VIII | 3.0 × 10$^{-4}$ mol/mol Ag |
| Coupler C-9 | 0.23 g/m$^2$ |
| Eleventh Layer: A Protective Layer | |
| A gelatin layer containing: | |
| Ultraviolet Absorber U-1 | 0.14 g/m$^2$ |
| Ultraviolet Absorber U-2 | 0.22 g/m$^2$ |
| Twelfth Layer: A Second Protective Layer | |
| A gelatin layer containing: | |
| Silver bromoiodide (silver iodide 2 mol %, average grain size: 0.07 μm) | 0.25 g/m$^2$ |
| Polymethacrylate particles (diameter: 1.5 μm) | 0.10 g/m$^2$ |

In addition to the above composition, a Gelatin Hardener H-1 and a surfactant were incorporated in each layer.

Samples 102–105

Samples 102 to 105 were prepared in the same manner as Sample 101 except that Compound (101) in the Ninth Layer of Sample 101 was replaced with Compounds (107), (106), (6) and (13) of the present invention at the levels of 0.037, 0.014, 0.250 and 0.100 g/m$^2$, respectively, to yield Samples 102 to 105.

Samples 106–111

Similarly, Samples 106 to 111 were prepared except that the amounts of compound (a) or (b) and compound (c) according to the present invention in the Ninth Layer were respectively reduced to one-half of the amounts used in Samples 101 to 105 as shown in Table 1.

Using an A light source filtered to a color temperature of 4,800° K., these samples were respectively exposed at 20 CMS and Treatments A and B were carried out at 38° C. in the following manner. (They were identical except for the difference in color development time and the sodium sulfite concentration in the developer.)

Moreover, exposure was made through a pattern for MTF measurement and after the following color development processing, the MTF at 40 cycles per mm was computed.

| Color Development | |
|---|---|
| Treatment A | 3 min 15 sec |
| Treatment B | 2 min 50 sec |
| Bleaching | 6 min 30 sec |
| Washing | 2 min 10 sec |
| Fixation | 4 min 20 sec |
| Washing | 3 min 15 sec |
| Stabilizing | 1 min 05 sec |

The processing compositions used in the respective steps were as follows.

| | |
|---|---|
| Color Developer | |
| Diethylenetriaminepentaacetic acid | 1.0 g |
| 1-Hydroxyethylidene-1,1-diphosphonic acid | 2.0 g |
| Sodium sulfite: | |
| Treatment A | 4.0 g |
| Treatment B | 1.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethylamino)-2-methylaniline sulfate | 4.5 g |
| Water to make | 1.0 liter |
| pH | 10.0 |
| Bleach Composition | |
| Ammonium Fe(III) ethylenediaminetetraacetate | 100.0 g |
| Disodium ethylenediaminetetraacetate | 10.0 g |
| Ammonium bromide | 150.0 g |
| Ammonium nitrate | 10.0 g |
| Water to make | 1.0 liter |
| pH | 6.0 |
| Fixing Composition | |
| Disodium ethylenediaminetetraacetate | 1.0 g |
| Sodium sulfite | 4.0 g |
| Ammonium thiosulfate (70% aq. soln.) | 175.0 ml |
| Sodium bisulfite | 4.6 g |
| Water to make | 1.0 liter |
| pH | 6.6 |
| Stabilizing Solution | |
| Formalin (40%) | 2.0 ml |

-continued

| | |
|---|---|
| Polyoxyethylene-p-monononyl phenyl ether (average degree of polymerization: about 10) | 0.3 g |
| Water to make | 1.0 liter |

TABLE 1

| Sample No. | Compound (a) or (b) | Compound (c) | Color Density* Treatment A | Color Density* Treatment B | MTF 40 c/mm Treatment A | MTF 40 c/mm Treatment B |
|---|---|---|---|---|---|---|
| 101 (Comparison) | — | (101) | 2.58 | 2.57 | 0.60 | 0.59 |
| 102 (Comparison) | — | (107) | 2.60 | 2.61 | 0.58 | 0.57 |
| 103 (Comparison) | — | (106) | 2.61 | 2.61 | 0.56 | 0.56 |
| 104 (Comparison) | (13) | — | 2.58 | 2.67 | 0.65 | 0.60 |
| 105 (Comparison) | (6) | — | 2.59 | 2.69 | 0.63 | 0.59 |
| 106 (Invention) | (13) | (101) | 2.58 | 2.59 | 0.64 | 0.64 |
| 107 (Invention) | " | (107) | 2.59 | 2.60 | 0.63 | 0.62 |
| 108 (Invention) | " | (106) | 2.59 | 2.60 | 0.62 | 0.62 |
| 109 (Invention) | (6) | (101) | 2.60 | 2.60 | 0.63 | 0.63 |
| 110 (Invention) | " | (107) | 2.60 | 2.62 | 0.63 | 0.62 |
| 111 (Invention) | " | (106) | 2.61 | 2.62 | 0.62 | 0.61 |

*The concentration of yellow color measured through a blue filter (Fuji Photo Film interference filter, dominant wavelength 436 nm) at an exposure level of 0.1 CMS.

It will be apparent from Table 1 that Samples 104 and 105, in which either compound (a) or compound (b) of the present invention was used alone, are remarkably processing dependent in regard to color density and sharpness (MTF), whereas Samples 106 through 111 according to the present invention are only slightly processing dependent and afford good sharpness in terms of MTF.

EXAMPLE 2

Sample 201

The following Ninth Layer (intermediate layer) was interposed between the Ninth and the Tenth Layers of Sample 101 of Example 1 with Compound (101) excluded from the Ninth Layer to prepare Sample 201.

Ninth Layer: An Intermediate Layer

| | |
|---|---|
| Compound (126) | 0.08 g/m$^2$ |
| Tricresyl phosphate | 0.15 g/m$^2$ |
| Gelatin | 0.60 g/m$^2$ |

Samples 202 and 203

Compound (126) was removed from the Ninth Layer of Sample 201 and Compounds (1) and (10) were added to the Ninth Layer at the levels of 0.100 g/m$^2$ and 0.030 g/m$^2$, respectively. Samples 202 and 203 were otherwise prepared in the same manner as Sample 201.

Samples 204 and 205

The compounds used in Samples 201, 202 and 203 were respectively employed in half the amounts in combination as shown in Table 2 to prepare Samples 204 and 205.

These samples were tested in the same manner as in Example 1. The results are set forth in Table 2.

It is apparent from Table 2 that Samples 204 and 205 according to the present invention are only slightly processing dependent and are very satisfactory in sharpness.

TABLE 2

| Sample No. | Compound (a) or (b) in 9th Layer | Compound (c) in 9th Layer | Color Density Treatment A | Color Density Treatment B | MTF, 40 c/mm Treatment A | MTF, 40 c/mm Treatment B |
|---|---|---|---|---|---|---|
| 201 (Comparison) | — | (126) | 2.54 | 2.53 | 0.57 | 0.56 |
| 202 (Comparison) | (1) | — | 2.48 | 2.54 | 0.60 | 0.58 |
| 203 (Comparison) | (10) | — | 2.47 | 2.55 | 0.58 | 0.56 |
| 204 (Invention) | (1) | (126) | 2.53 | 2.54 | 0.60 | 0.60 |
| 205 (Invention) | (10) | (126) | 2.52 | 2.54 | 0.59 | 0.59 |

EXAMPLE 3

Samples 301–303

In lieu of Compound (101) used in the Third Layer of Sample 101, Compounds (104), (133) and (7) were added at levels of 0.045 g/m$^2$, 0.018 g/m$^2$ and 0.110 g/m$^2$, respectively, to yield Samples 301 to 303. Samples 301 to 303 were otherwise prepared in the same manner as Sample 101.

Samples 304 and 305

The amounts of the compounds of the present invention in the Third Layer were respectively reduced to one half the amounts in Samples 301 to 303 as shown in Table 3 to prepare Samples 304 and 305.

These samples were respectively exposed under the same conditions as in Example 1 and then processed in the following development process using a fresh processing composition or by running processing as mentioned below. The color density was measured through a red filter (interference filter, dominant wavelength 646 nm). The results are shown in Table 3.

Fresh processing composition means the fresh bath described below. Running processing means processing with the processing composition after the following history. Thus, Sample 301 was cut into strips 3.5 cm wide and 12 cm long and, after exposure at 20 CMS at intervals of 3 frames, the strips were developed using the process described below using 2 liters of the fresh bath. Thus, 2.2 m$^2$ of Sample 301 was continuously processed while the processing bath was replenished with 50 ml of the supplemental solution once after every processing of 350 cm$^2$.

| Step | Temperature | Time |
|---|---|---|
| Color Development | 38° C. | 3 min |
| Bleaching | " | 1 min 30 sec |
| Fixing | " | 3 min |
| Washing | " | 3 min |
| Stabilizing | " | 1 min |

| | Fresh Bath | Supplemental Solution |
|---|---|---|
| Color Developer Composition | | |
| Sodium nitrilotriacetate | 1.0 g | 1.1 g |
| Sodium sulfite | 4.0 g | 4.4 g |
| Sodium carbonate | 30.0 g | 32.0 g |
| Potassium bromide | 1.4 g | 0.7 g |
| Hydroxylamine sulfate | 2.4 g | 2.6 g |
| 4-(N-Ethyl-N-β-hydroxyethylamino)-2-methylaniline sulfate | 4.5 g | 5.0 g |
| Water to make | 1 l | 1 l |
| Bleach Composition | | |
| Ammonium bromide | 160.0 g | 176 g |
| Aqueous ammonia (28%) | 25.0 ml | 15 ml |
| Sodium Fe(II) ethylenediaminetetraacetate | 130.0 g | 143 g |
| Glacial acetic acid | 14.0 ml | 14.0 ml |
| Water to make | 1 l | 1 l |
| Fixing Composition | | |
| Sodium tetrapolyphosphate | 2.0 g | 2.2 g |
| Sodium sulfite | 4.0 g | 4.4 g |
| Ammonium thiosulfate (70%) | 175.0 ml | 193.0 ml |
| Sodium bisulfite | 4.6 g | 5.1 g |
| Water to make | 1 l | 1 l |
| Stabilizing Composition | | |
| Formalin | 8.0 ml | 9.0 ml |
| Water to make | 1 l | 1 l |

It will be apparent from Table 3 that whereas Sample 303 containing compound (a) or (b) alone is highly processing dependent, the application of the present invention results in decreased processing dependence and excellent sharpness.

TABLE 3

| Sample No. | Compound (a) or (b) | Compound (c) | Color Density* Fresh Composition | Color Density* Running Composition | MTF with Fresh Composition** |
|---|---|---|---|---|---|
| 301 (Comparison) | — | 104 | 1.43 | 1.45 | 0.51 |
| 302 (Comparison) | — | 133 | 1.43 | 1.44 | 0.50 |
| 303 (Comparison) | 7 | — | 1.45 | 1.51 | 0.54 |
| 304 (Invention) | " | 104 | 1.44 | 1.45 | 0.54 |
| 305 (Invention) | " | 133 | 1.44 | 1.44 | 0.53 |

*Density through a red filter at an exposure level of 0.1 CMS.
**The MTF measured at 25 cycles/mm in processing with the fresh composition.

EXAMPLE 4

Sample 401

Sample 401 was prepared in the same manner as Sample 101 except that, in lieu of Compound (101) in the Third Layer of Sample 101, Compound (126) was used at a level of 0.030 g/m$^2$ (0.24 mol % relative to silver halide in the Third Layer).

Samples 402–404

Samples 402 through 404 were prepared by replacing Compound (126) in the Third Layer of Sample 401 with Compound (134) (DIR Compound-1 in Japanese Patent Application (OPI) No. 57-155537), Compound (7) and Compound C-10 (Compound (22) in Japanese Patent Application (OPI) No. 57-155537) at levels of 0.3 mol %, 0.7 mol % and 3.0 mol %, respectively, per mol of silver halide in the Third Layer.

Samples 405–408

Samples 405 through 408 were prepared by halving the amounts of Compound (126), Compound (134), Compound (7) and Compound C-10 used in Samples 401 through 404 as shown in Table 4.

The above samples were subjected to Color Development Treatment B of Example 1 and their photographic characteristics and MTF values were determined as shown in Table 4.

TABLE 4

| Sample No. | Compound (a) or (b) or a Substitute Therefor | Compound (c) | Relative Sensitivity* | MTF (40 c/mm) |
|---|---|---|---|---|
| 401 (Comparison) | — | (126) | 100 | 0.57 |
| 402 (Comparison) | — | (134) | 98 | 0.56 |
| 403 (Comparison) | (7) | — | 100 | 0.57 |
| 404 (Comparison) | (C-10) | — | 102 | 0.55 |
| 405 (Invention) | (7) | (126) | 100 | 0.62 |
| 406 (Comparison) | (C-10) | " | 102 | 0.56 |
| 407 (Invention) | (7) | (134) | 98 | 0.61 |
| 408 (Comparison) | (C-10) | " | 100 | 0.55 |

*The reciprocal of the amount of exposure that gives a density of fog + 0.2 as a relative value with the value of Sample 401 being taken as 100.

It will be seen from Table 4 that Samples 405 and 407 according to the present invention are superior in sharpness and in terms of MTF.

Structural Formulae of the Compounds Used in the Examples

U-1

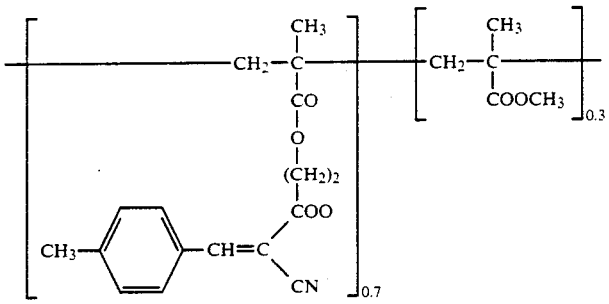

(The subscripts (0.7 and 0.3 in this case) indicate the weight ratio.)

U-2

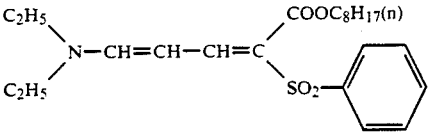

C-1

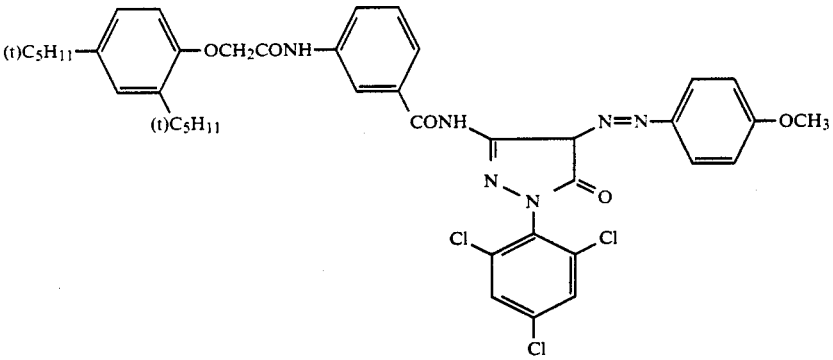

C-2

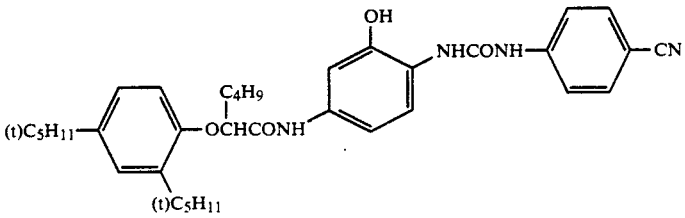

-continued
Structural Formulae of the Compounds Used in the Examples
C-3
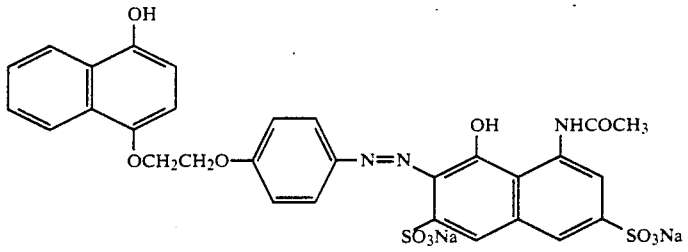
C-4
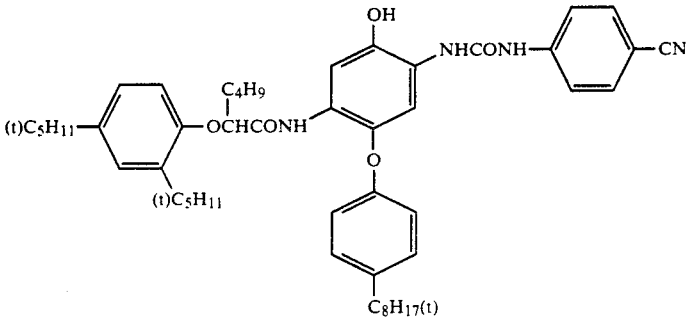
C-5
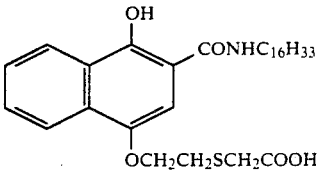
C-6
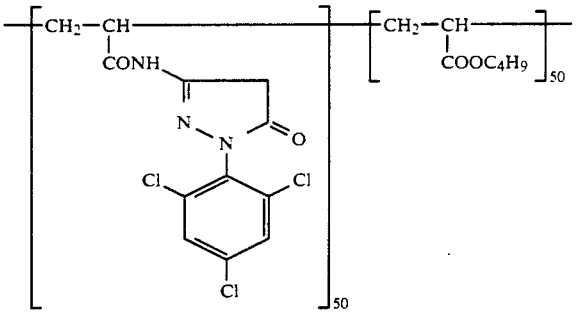
C-7
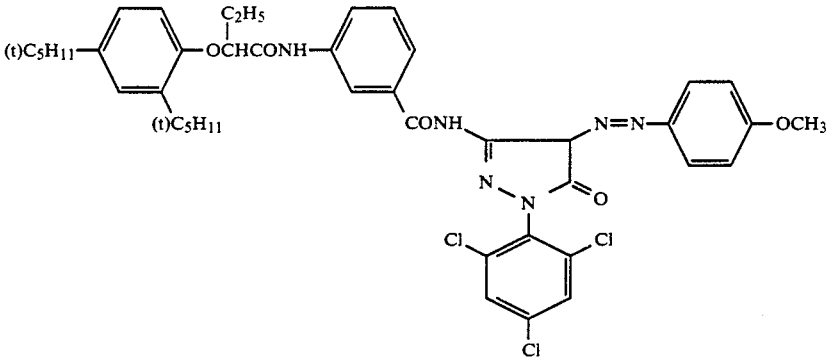
C-8

-continued
Structural Formulae of the Compounds Used in the Examples
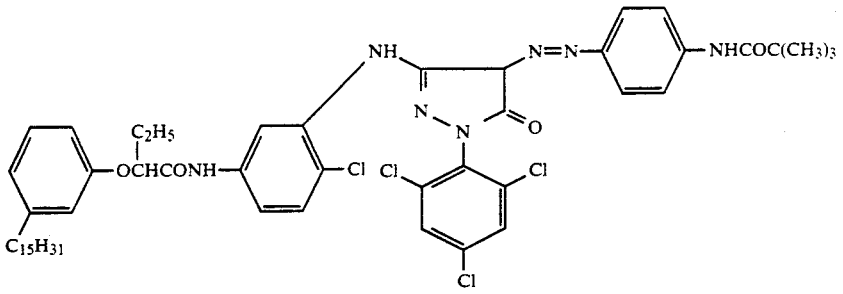
C-9
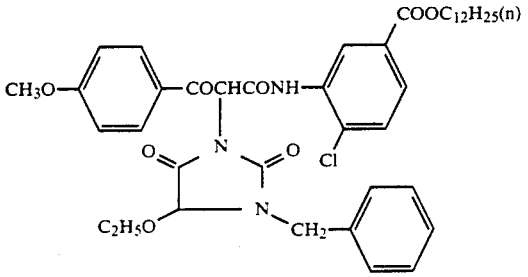
C-10
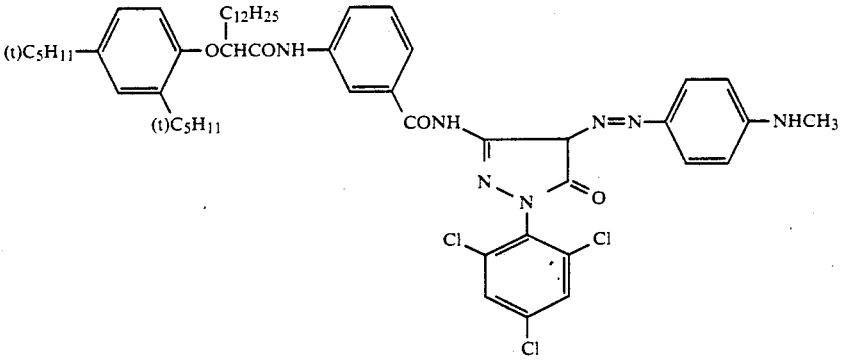
(Compound (22) described in Japanese Patent Application (OPI) No. 57-155537)
H-1
$CH_2{=}CH{-}SO_2{-}CH_2CONH{-}(CH_2)_2NHCOCH_2{-}SO_2{-}CH{=}CH_2$
Sensitizing Dye I
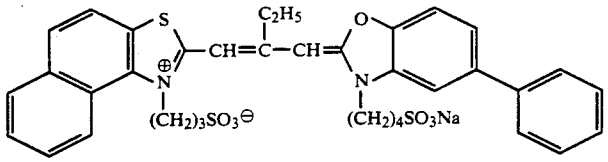
Sensitizing Dye II
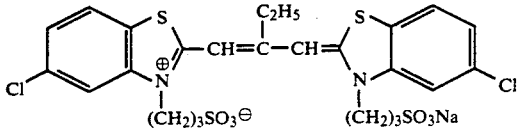
Sensitizing Dye III -continued Structural Formulae of the Compounds Used in the Examples

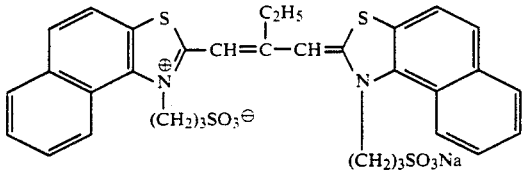

Sensitizing Dye IV

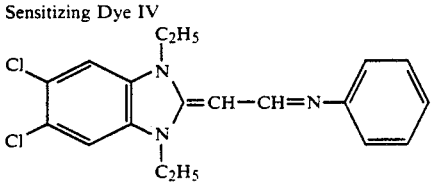

Sensitizing Dye V

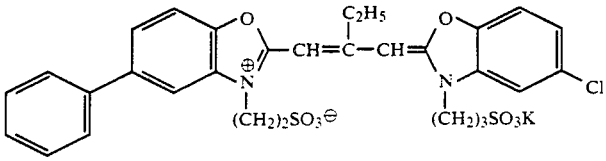

Sensitizing Dye VI

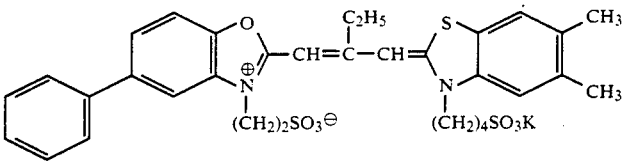

Sensitizing Dye VII

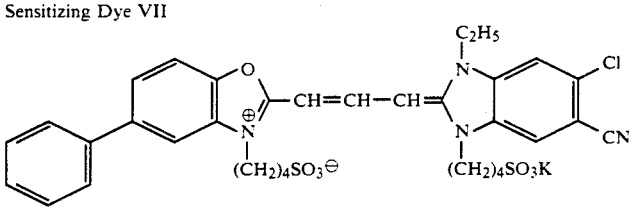

Sensitizing Dye VIII

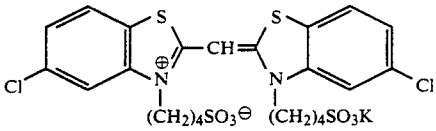

EXAMPLE 5

Samples 301 to 305 used in Example 3 were respectively exposed under the same conditions as in Example 1 and, then, processed in the following development process using an automatic developing machine (Fuji Color Negative Film Processor FP-350) as mentioned in Table 5 below.

The amount of the supplemental solution replenished in the washing step (2) was about 60 time (in Treatment C) and about 13 time (in Treatment D) the amount (per 1 $m^2$ of the photosensitive material) of the processing composition brought from the previous bath together with the photosensitive material.

TABLE 5

| Step | Time | Temp. | Tank Capacity | Supplement Amount* Treatment C | Supplement Amount* Treatment D |
|---|---|---|---|---|---|
| Color Development | 3 min 15 sec | 38° C. | 18 l | 38 ml | 38 ml |
| Bleaching | 6 min 30 sec | " | 36 l | 18 ml | 18 ml |
| Fixing | 3 min 15 sec | " | 18 l | 33 ml | 33 ml |
| Washing (1) | 1 min 30 sec | " | 9 l | — | — |
| Washing (2) | 1 min 30 sec | " | 9 l | 125 ml | 27 ml |

TABLE 5-continued

| Step | Time | Temp. | Tank Capacity | Supplement Amount* Treatment C | Treatment D |
|---|---|---|---|---|---|
| Stabilizing | 40 sec | " | 9 l | 33 ml | 33 ml |

note:
"*" is amount per the area (35 mm width × 1 m length) of the photosensitive material.

In the above processing steps, the washing steps (1) and (2) were carried out in accordance with the countercurrent method of from step (2) to step (1).

The following processing compositions were used.

| | Fresh Bath | Supplemental Solution |
|---|---|---|
| Color Developer Composition | | |
| Diethylenetriaminepentaacetic acid | 1.0 g | 1.0 g |
| 1-Hydroxyethylidene-1,1-diphosphonic acid | 2.0 g | 2.2 g |
| Sodium sulfite | 4.0 g | 4.4 g |
| Potassium carbonate | 30.0 g | 32.0 g |
| Potassium bromide | 1.4 g | 0.7 g |
| Potassium iodide | 1.3 mg | — |
| Hydroxylamine sulfate | 2.4 g | 2.6 g |
| 4-(N-Ethyl-N-β-hydroxyethylamino)-2-methylaniline sulfate | 4.5 g | 5.0 g |
| Water to make | 1 l | 1 l |
| | pH 10.00 | pH 10.05 |
| Bleach Composition | | |
| Ammonium Fe(III) ethylenediaminetetraacetate | 100 g | 110 g |
| Disodium ethylenediaminetetraacetate | 10.0 g | 11.0 g |
| Aqueous ammonia | 7 ml | 5 ml |
| Ammonium nitrate | 10.0 g | 12.0 g |
| Ammonium bromide | 150 g | 170 g |
| Water to make | 1 l | 1 l |
| | pH 6.0 | pH 5.8 |
| Fixing Composition | | |
| Disodium ethylenediaminetetraacetate | 1.0 g | 1.2 g |
| Sodium sulfite | 4.0 g | 5.0 g |
| Sodium bisulfite | 4.6 g | 5.8 g |
| Ammonium thiosulfate (70% aq. soln.) | 175 ml | 200 ml |
| Water to mate | 1 l | 1 l |
| | pH 6.6 | pH 6.6 |
| Washing Composition | | |
| 2-methyl-isothiazoline-3-one | 10 mg | 10 mg |
| 5-chloro-2-methylisothiazoline-3-one | 10 mg | 10 mg |
| Water to make | 1 l | 1 l |
| adjusted with sodium hydroxide | pH 7.0 | pH 7.0 |
| Stabilizing Composition | | |
| Formalin (37% W/V) | 2.0 ml | 3.0 ml |
| Polyoxyethylene-p-monononyl phenyl ether (average degree of polymerization: 10) | 0.3 g | 0.45 g |
| Water to make | 1 l | 1 l |

The imagewise-exposed color photosensitive material Samples 301 to 305 (35 m/m width) were continuously processed in the proportion of 20 m/day for 20 days using an automatic developing machine having the tank capacity mentioned in Table 5.

The photographic properties of these samples obtained were evaluated in the same manner as in Example 3. As a result, same results as in Example 3 were obtained in both treatments C and D.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having dispersed thereon at least one layer each of blue sensitive silver halide emulsion, green sensitive silver halide emulsion and red sensitive silver halide emulsion layer units, wherein at least one of (a) a compound which upon reaction with an oxidized developing agent, forms a compound which on oxidation forms a development inhibitor or precursor thereof and;

(b) a compound which upon reaction with an oxidized developing agent, forms a precursor of a compound which on oxidation forms a development inhibitor or precursor thereof; and (c) a compound which on reaction with an oxidized developing agent, releases a development inhibitor or a precursor thereof, wherein the precursor is not capable of reacting with an oxidized developing agent to form a development inhibitor;

and wherein said at least one (a) and/or at least one (b) and at least one (c) are incorporated in the same color sensitive layer or in the same non-sensitive layer.

2. The silver halide color photographic material as in claim 1, wherein said compound (a) and compound (b) are represented by general formula (I)

$$A\text{-}B\text{-}D \qquad (I)$$

wherein A is a coupler residue which reacts with an oxidized color developing agent to cleave from B; B is either a group which is oxidized after cleavage of A from B and thereby cleaved from D or a precursor thereof; and D is a development inhibitor or a precursor thereof.

3. The silver halide color photographic material as in claim 2, wherein A represents a yellow coupler residue, a magenta coupler residue, a cyan coupler residue, or a colorless coupler residue.

4. The silver halide color photographic material as in claim 2, wherein B is a group of general formula (B-1):

$$*\text{-}(B_1)_v\text{-}\underset{\underset{(B_2)_w}{|}}{RED}\text{-}** \qquad (B\text{-}1)$$

wherein the mark "*" indicates the position of attachment to A; the mark "**" indicates the position of attachment to D; $B_1$ is a linking group adapted to cleave from RED only after cleavage of the bond between $B_1$ and A; $B_2$ is a group adapted to react with an alkali, hydroxylamine, sulfite or like ion present in the development environment to undergo cleavage from RED; RED is a group that is rendered oxidizable only after cleavage of its bonds with $B_1$ and $B_2$ and, upon oxidation, cleaves from D, wherein D has the same meaning as defined in general formula (I); and v and w each represents 0 or 1.

5. The silver halide color photographic material as in claim 4, wherein the group RED is a group represented by general formula (R-1):

$$*\text{-}(P\text{-}X{=}Y)_n Q\text{-}** \qquad (R\text{-}1)$$

wherein the mark * indicates the position of attachment to A-(B1)v; the mark ** indicates the position of attachment to B2, when w=1, or a hydrogen atom, when w=0; P and Q each is an oxygen atom or a substituted or unsubstituted imino group; at least one of the n occurrences of X and of the n occurrences of Y is a methine group having D, wherein D has the same meaning as defined for general formula (I), as a substituent and the remaining occurrences of X and Y each is/are a substituted or unsubstituted methine group or a nitrogen atom; n is an integer of 1 to 3 and when n is not less than 2, n occurrences of Y can either be the same or different.

6. The silver halide color photographic material as in claim 2, wherein D is a group represented by general formula (D-1):

$$*\text{-}(B_1)_q\text{-}DI \qquad \text{(D-1)}$$

wherein the mark * indicates the position of attachment to B; $B_1$ is a linking group adapted to cleave from B only after cleavage of the bond between $B_1$ and A; q is 0 or 1; and DI is a development inhibitor.

7. The silver halide color photographic material as in claim 2, wherein compound (a) and compound (b) are represented by general formulae (II) and (III)

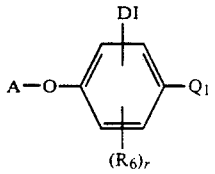

(II)

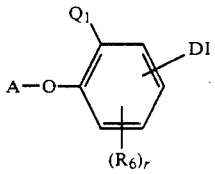

(III)

wherein A is a coupler residue which reacts with an oxidized color developing agent to cleave from B; DI is a development inhibitor; $Q_1$ is a hydroxy or sulfonamido group; $R_6$ is a hydrogen atom or a substituent group; and r is an integer of 1 to 3.

8. The silver halide color photographic material as in claim 1, wherein said compound (c) is represented by general formula (IV):

$$A\text{-}(B_1)_v\text{-}DI \qquad \text{(IV)}$$

wherein A is a coupler residue which reacts with an oxidized color developing agent to cleave from $B_1$; $B_1$ is a linking group adapted to cleave from DI only after cleavage of the bond between $B_1$ and A; v represents 0 or 1; and DI is a development inhibitor.

9. The silver halide color photographic material as in claim 8, wherein v in said formula (IV) is 0.

10. The silver halide color photographic material as in claim 1, wherein compound (a) and/or (b) is present in total amounts of $10^{-7}$ to $10^{-2}$ mol/m$^2$.

11. The silver halide color photographic material as in claim 10, wherein the total amounts are $10^{-6}$ to $10^{-3}$ mol/m$^2$.

12. The silver halide color photographic material as in claim 11, wherein the total amounts are $3\times10^{-6}$ to $5\times10^{-4}$ mol/m$^2$.

13. The silver halide color photographic material as in claim 1, wherein compound (c) is present in the same color sensitive layer unit or non-sensitive layer in a total amount of $10^{-8}$ to $10^{-2}$ mol/m$^2$.

14. The silver halide color photographic material as in claim 13, wherein the total amount is $10^{-7}$ to $10^{-3}$ mol/m$^2$.

15. The silver halide color photographic material as in claim 14, wherein the total amount is $10^{-6}$ to $3\times10^{-4}$ mol/m$^2$.

16. The silver halide color photographic material as in claim 4, wherein $B_1$ is a group which utilizes a hemiacetal cleavage reaction.

17. The silver halide color photographic material as in claim 16, wherein $B_1$ is represented by general formula:

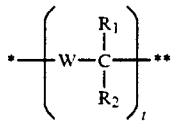

wherein the mark * indicates the position of attachment to A; the mark ** indicates the position of attachment to RED; W represents an oxygen atom or a group

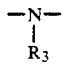

where $R_3$ is an organic substituent group; $R_1$ and $R_2$ each represents a hydrogen atom or a substituent group; t represents 1 or 2 and when t is 2, $R_1$ and $R_2$ may be the same or different; and any two of $R_1$, $R_2$ and $R_3$ may be combined to form a cyclic structure.

18. The silver halide color photographic material as in claim 4, wherein $B_1$ is a group such that cleavage is induced by an intramolecular nucleophilic displacement.

19. The silver halide color photographic material as in claim 4, wherein $B_1$ is a group such that cleavage is induced by an electron transfer along a conjugated system.

20. The silver halide color photographic material as in claim 19, wherein $B_1$ is represented by general formula:

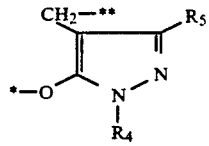

wherein the mark * indicates the position of attachment to A; the mark ** indicates the position of attachment to RED; and $R_4$ and $R_5$ each is a hydrogen atom or a substituent group.

21. A silver halide color photographic material as in claim 4, wherein at least one of v or w represent 1.

22. A silver halide color photographic material as in claim 8, wherein v represents 1.

23. The silver halide color photographic material as in claim 7, wherein the substituent group for $R_6$ is selected from the group consisting of aliphatic groups, halogen atoms, alkoxy groups, alkylthio groups, aryloxy groups, arylthio groups, carbamoyl groups, alkoxy carbonyl groups, aryloxy carbonyl groups, sulfonyl groups, sulfamoyl groups, acyl amino groups, sulfonamido groups, acyl groups, nitroso groups, acyloxy groups, ureido groups, imido groups, a nitro group, a cyano group, heterocyclic groups, a hydroxy group, a carboxy group, alkoxycarbonyl amino groups, a sulfo group, an amino group, anilino groups, sulfatic amino groups, sulfinyl groups, sulfamoylamino groups, thioacyl groups, thiouredo groups and heterocyclic amino groups.

* * * * *